US007059699B2

(12) United States Patent
Asauchi et al.

(10) Patent No.: US 7,059,699 B2
(45) Date of Patent: Jun. 13, 2006

(54) INK TANK WITH DATA STORAGE FOR DRIVE SIGNAL DATA AND PRINTING APPARATUS WITH THE SAME

(75) Inventors: Noboru Asauchi, Nagano-ken (JP); Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/117,132

(22) Filed: Apr. 8, 2002

(65) Prior Publication Data

US 2003/0016257 A1 Jan. 23, 2003

Related U.S. Application Data

(60) Provisional application No. 60/306,419, filed on Jul. 20, 2001.

(51) Int. Cl.
*B41J 29/38* (2006.01)

(52) U.S. Cl. ..... 347/10; 347/19; 347/86

(58) Field of Classification Search ..... 347/7, 347/10, 11, 12, 68, 14, 86
See application file for complete search history.

(56) References Cited

U.S. PATENT DOCUMENTS

| | | | | |
|---|---|---|---|---|
| 5,506,611 | A * | 4/1996 | Ujita et al. | 347/86 |
| 5,610,635 | A * | 3/1997 | Murray et al. | 347/7 |
| 5,663,750 | A * | 9/1997 | Sakuma | 347/7 |
| 5,694,156 | A * | 12/1997 | Hoisintong et al. | 347/7 |
| 5,788,388 | A * | 8/1998 | Cowger et al. | 400/703 |
| 5,988,782 | A * | 11/1999 | Miura et al. | 347/6 |
| 6,022,093 | A * | 2/2000 | Arai et al. | 347/14 |
| 6,102,517 | A | 8/2000 | Kobayashi et al. | 347/23 |
| 6,158,850 | A * | 12/2000 | Cook | 347/85 |
| 6,170,933 | B1 * | 1/2001 | Nitta et al. | 347/42 |
| 6,467,864 | B1 * | 10/2002 | Cornell | 347/14 |
| 6,467,865 | B1 * | 10/2002 | Iwamura et al. | 347/14 |

FOREIGN PATENT DOCUMENTS

| | | |
|---|---|---|
| JP | 02-279344 | 11/1990 |
| JP | 3-67657 | 3/1991 |
| JP | 4-133746 | 5/1992 |
| JP | 6-286159 | 10/1994 |
| JP | 9-183224 | 7/1997 |
| JP | 2000-153608 | 6/2000 |
| WO | WO 97/23352 | 7/1997 |

* cited by examiner

*Primary Examiner*—Hai Pham
*Assistant Examiner*—Lam Nguyen
(74) *Attorney, Agent, or Firm*—Oblon, Spivak, McClelland, Maier & Neustadt, P.C.

(57) ABSTRACT

Images can be printed using any type of ink by providing a print head comprising a plurality of nozzles for ejecting ink from ink tank equipped with a memory. The memory contains drive waveform data for reproducing waveforms of drive signals used to actuate the plurality of drive elements. The drive signals are generated based on the drive waveform data stored in the memory of the ink tank, allowing various types of inks to be used by the same printer. In particular, crisp printing can be attained using ink tanks developed after the printer has been shipped.

25 Claims, 21 Drawing Sheets

| Data | Specifics |
|---|---|
| Ink type data | Dye inks($K_D$、$Y_D$、$C_D$、$C_L$、$M_D$、$M_L$) |
| Drive waveform data | Drive waveform data for dye inks |
| Mask data | Mask data for dye inks |

| Data | Specifics |
|---|---|
| Ink type data | Dye inks ($K_D$、$Y_D$、$C_D$、$M_D$ ) pigment inks ($C_L$、$M_L$) |
| Drive waveform data | Drive waveform data for dye/pigment combinations |
| Mask data | Mask data for dye/pigment combinations |

Dye ink

Pigment ink

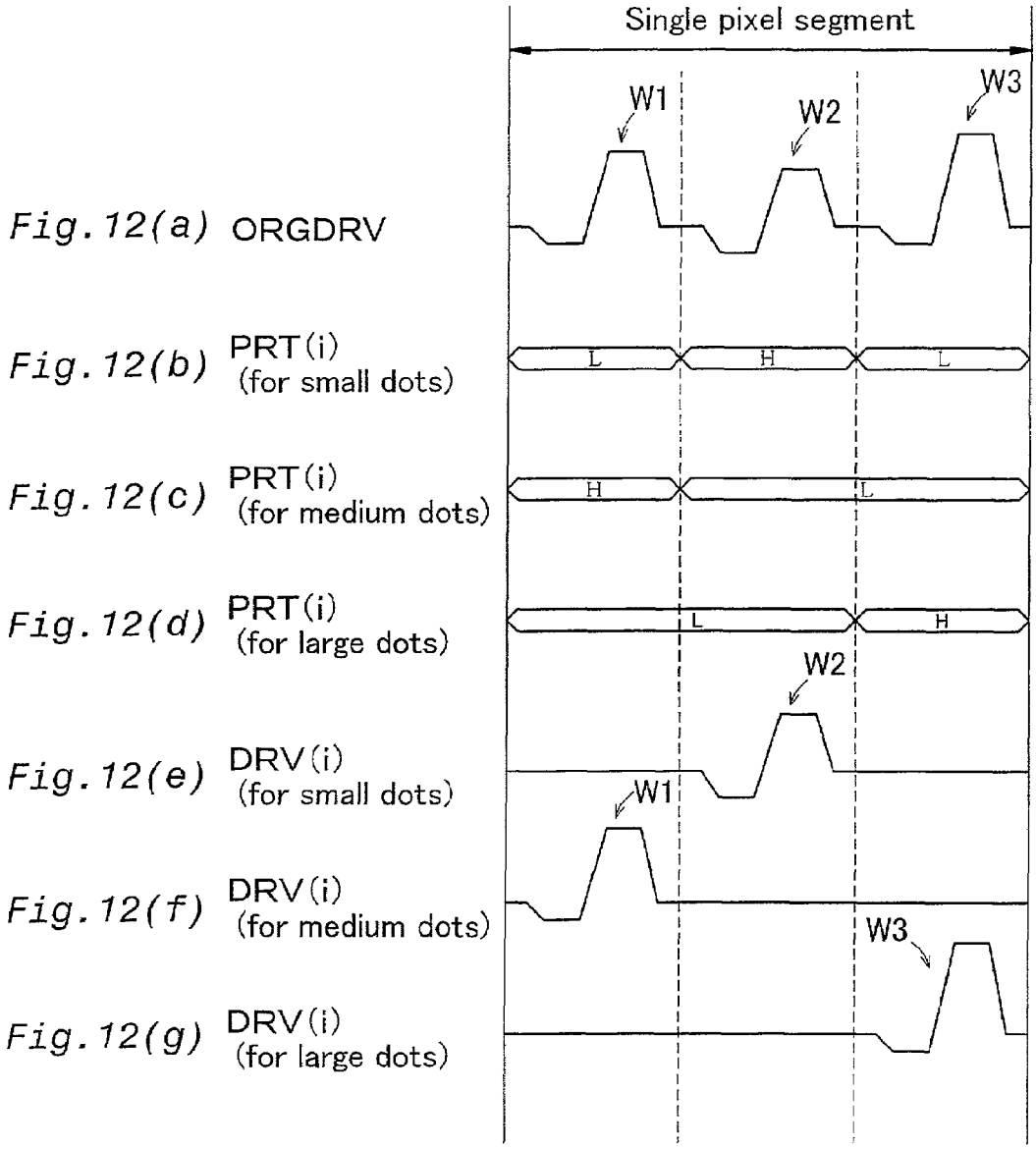
Single pixel segment
W1
W2
W3
Fig.12(a) ORGDRV
Fig.12(b) PRT(i) (for small dots)
L
H
L
Fig.12(c) PRT(i) (for medium dots)
H
L
Fig.12(d) PRT(i) (for large dots)
L
H
W2
Fig.12(e) DRV(i) (for small dots)
W1
Fig.12(f) DRV(i) (for medium dots)
W3
Fig.12(g) DRV(i) (for large dots)

| Data | Specifics |
|---|---|
| Ink type data | Dye inks ($K_D$, $Y_D$, $C_D$, $M_D$) pigment inks ($C_L$, $M_L$) |
| Drive waveform data | Drive waveform data for dye/pigment combinations |
| Mask data | Two types of mask data suitable for ejecting dye and pigment inks separately in accordance with drive waveforms for combined environment |

Dye ink
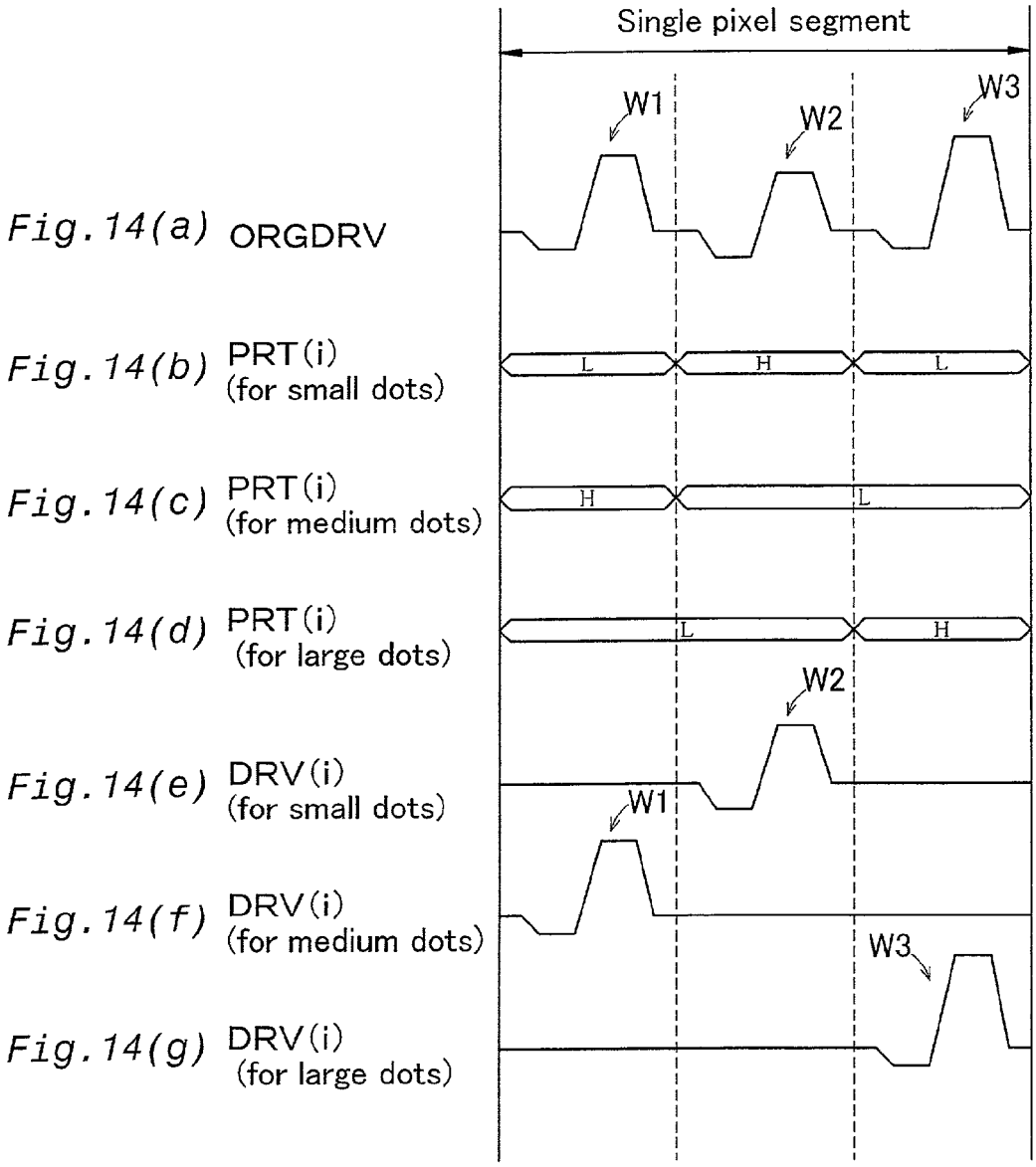

Pigment ink
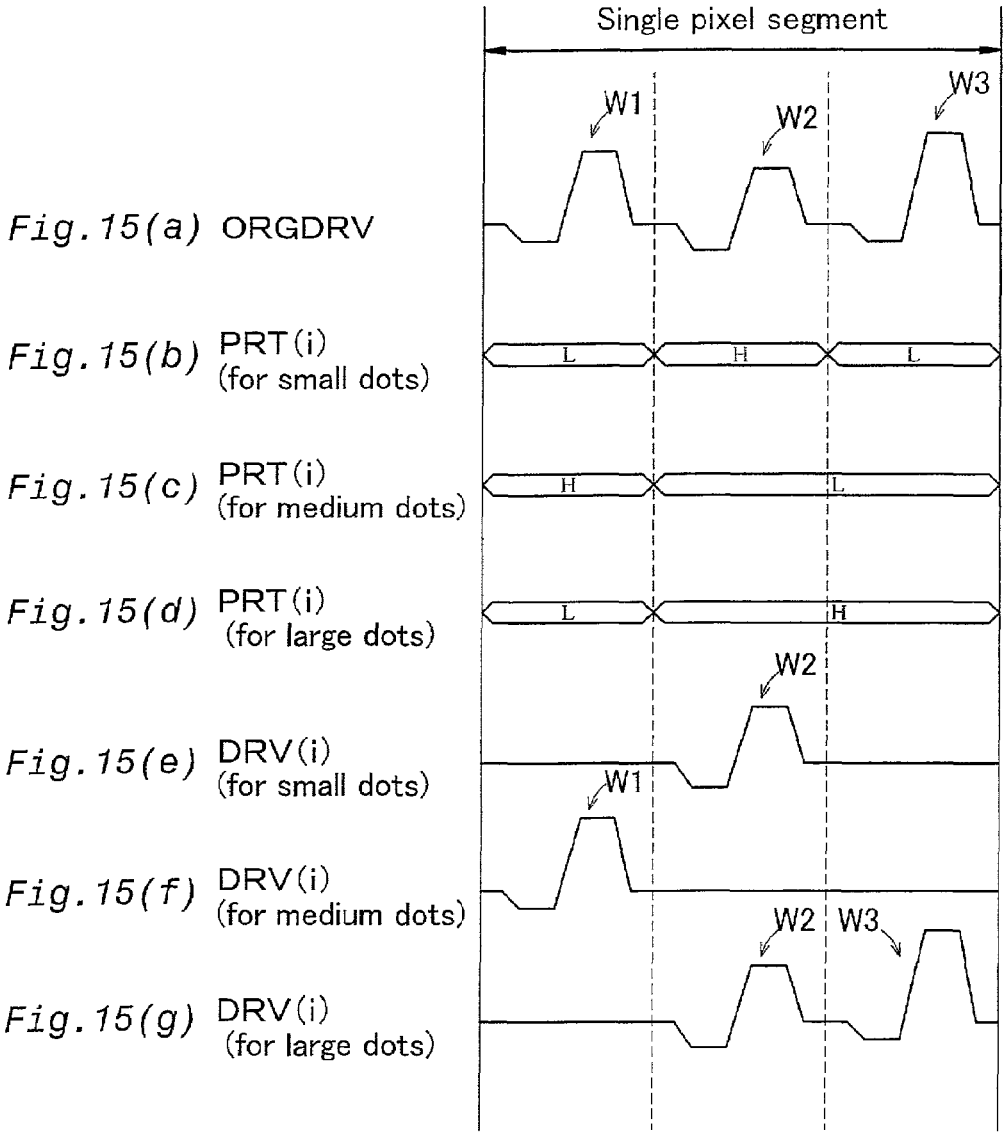

Fig. 16(a)

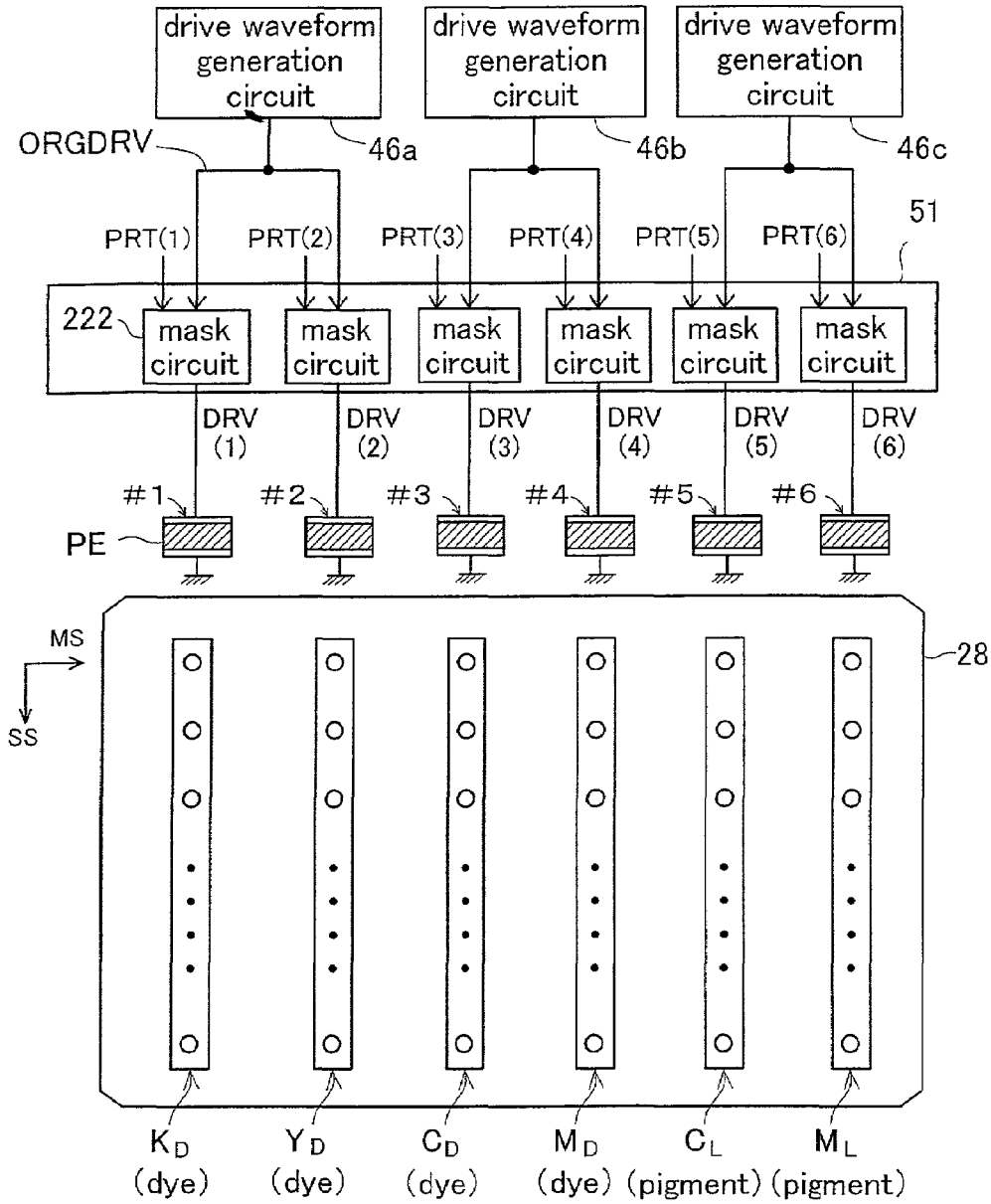

Fig. 16(b)

| Data | Specifics |
|---|---|
| Ink type data | 1. Dye inks ($K_D$, $Y_D$, $C_D$, $M_D$)<br>2. Pigment inks ($C_L$, $M_L$) |
| Drive waveform data | 1. Drive waveform data for pigment inks<br>2. Drive waveform data for dye inks |
| Mask data | 1. Data suitable for ejecting pigment inks in accordance with drive waveforms for pigment inks<br>2. Data suitable for ejecting dye inks in accordance with drive waveforms for dye inks |

Fig.21

| Data | Specifics |
|---|---|
| Ink type data ITD | Dye ink |
| Drive waveform data DW1 | Drive waveform data for dye inks |
| Mask data MD1 | Mask data for dye inks |
| Drive waveform data DW2 | Drive waveform data for dye/pigment combinations |
| Mask data MD2 | Mask data for dye/pigment combinations |
| Correction data CD | Correction specifics based on humidity, print head temperature, actuator rank |
| Ink remainder IR | Amount of ink remaining in ink tank |

INK TANK WITH DATA STORAGE FOR DRIVE SIGNAL DATA AND PRINTING APPARATUS WITH THE SAME

BACKGROUND OF THE INVENTION

1. Field of the Invention

The present invention relates to a printing apparatus such as an ink-jet printer, and ink-jet plotter, and to an ink tank mounted on the printing apparatus, and more particularly to a technique for controlling printing on the basis of information stored in a data storage attached to the ink tank.

2. Description of the Related Art

Color printers for ejecting inks of multiple colors from an ink head are currently used on a wide scale as output apparatus for computers. Dye inks or pigment inks can be cited as examples of the inks of multiple colors used in such color printers. As used herein, the term "dye ink" refers to an ink in which a dye is used as the ink colorant, and the term "pigment ink" refers to an ink in which a pigment is used as the ink colorant. Using a dye ink allows translucent colors to be formed on a print medium, whereas using a pigment ink allows distinct colors (solid colors) to be formed on a print medium. Another advantage of using a pigment ink is that characters or images can be printed with minimal bleeding.

Pigment and dye inks spread differently across a print medium. Specifically, a dye ink tends to spread or bleed across a print medium, whereas a pigment ink resists spreading or bleeding across a print medium. Consequently, different amounts of ink are required for a pigment ink drop and a dye ink drop in order to form dots of the same size on a print medium, and different drive waveforms must be employed for pigment ink and dye ink, respectively.

A conventional printer, however, has internal printer firmware with a single drive waveform. The resulting drawback is that, for example, a printer fabricated for a pigment ink cannot use a dye ink.

SUMMARY OF THE INVENTION

Accordingly, an object of the present invention is to provide a technique that allows various types of inks to be used on a single printer.

In order to attain the above and the other objects of the present invention, there is provided a printing apparatus for printing by forming ink dots on a print medium. The printing apparatus comprises: a print head, an ink tank mount, a memory read unit, and a drive signal generator. The print head has a plurality of nozzles for ejecting ink and a plurality of drive elements for actuating the plurality of nozzles. The ink tank mount is capable of supporting an ink tank equipped with a memory. The memory stores drive waveform data to be used in generating a waveform of a drive signal to actuate the plurality of drive elements. The memory read unit is configured to read out the drive waveform data from the memory. The drive signal generator is configured to generate the drive signals based on the drive waveform data.

In the printing apparatus of the present invention, the drive signals are generated based on the drive waveform data stored in the memory of the ink tank, allowing various types of inks to be used by the same printer. In particular, clear printing can be attained using ink tanks developed after the printer has been shipped.

In a preferred embodiment of the invention, the memory is a write-once memory. This will prevent an inadvertent change of the drive waveform data.

In another preferred embodiment of the invention, the memory is a rewritable nonvolatile memory. The memory read unit is configured to further read out an initial amount of each type of ink in each ink tank from the nonvolatile memory at least when the ink tank is mounted on the ink tank mount. The printing apparatus further comprises: a calculating unit, a calculating unit, and a memory write unit. The calculating unit is configured to calculate a remaining amount of each type of ink in each ink tank based on an amount of ejected ink from each ink tank and the initial amount of each type of ink. The memory write unit is configured to write in the nonvolatile memory the remaining amount of each type of ink in each ink tank at an end of printing. The drive signal generator is configured to correct the drive waveform in response to the remaining amount of each type of ink.

Thus, drive waveforms can be corrected in response to the amount of remaining ink when the ink tank has been replaced. This is achieved by adopting an arrangement in which the ink tank is further provided with a nonvolatile memory and the amount of remaining ink is written in the nonvolatile memory of the ink tank in cases in which the memory for storing drive waveform data is a write-once memory.

The present invention can be realized in various forms such as a method and apparatus for printing, a method and apparatus for producing print data for a printing unit, and a computer program product implementing the above scheme.

These and other objects, features, aspects, and advantages of the present invention will become more apparent from the following detailed description of the preferred embodiments with the accompanying drawings.

BRIEF DESCRIPTION OF THE DRAWING

FIG. 6(*b*) is a diagram depicting the specifics of data stored in the memory provided to the ink tank;

FIG. 7(*b*) is a diagram depicting the specifics of data stored in the memory provided to the ink tank;

FIG. 9(*b*) is a diagram depicting appropriate drive waveforms for pigment ink;

FIGS. 12(*a*)–12(*g*) are time charts depicting the operation of the interior components of a head drive circuit pertaining to the first embodiment;

FIG. 13(*b*) is a diagram depicting the specifics of data stored in the memory provided to the ink tank;

FIGS. 14(*a*)–14(*g*) are timing charts depicting the operation of the interior components of a head drive circuit pertaining to the second embodiment;

FIGS. 15(*a*)–15(*g*) are timing charts depicting the operation of the interior components of a head drive circuit pertaining to the second embodiment;

FIG. 16(*a*) is a diagram depicting the structure of a drive circuit for a print head 28 pertaining to a third embodiment of the present invention;

FIG. 16(*b*) is a diagram depicting the specifics of data stored in the memory provided to the ink tank;

FIG. 21 is a diagram depicting the data stored in the memory provided to the ink cartridge of the present invention.

DESCRIPTION OF THE PREFERRED EMBODIMENT

Embodiments of the present invention will now be described through embodiments in the following sequence.

A. Apparatus Structure
B. Embodiments
C. Correction of Drive Waveforms
D. Selection of Cleaning Method
E. Specifics of Data Stored in Memory Provided to Ink Tank or Ink Cartridge
F. Modified Examples

A. Apparatus Structure

Figure 1:
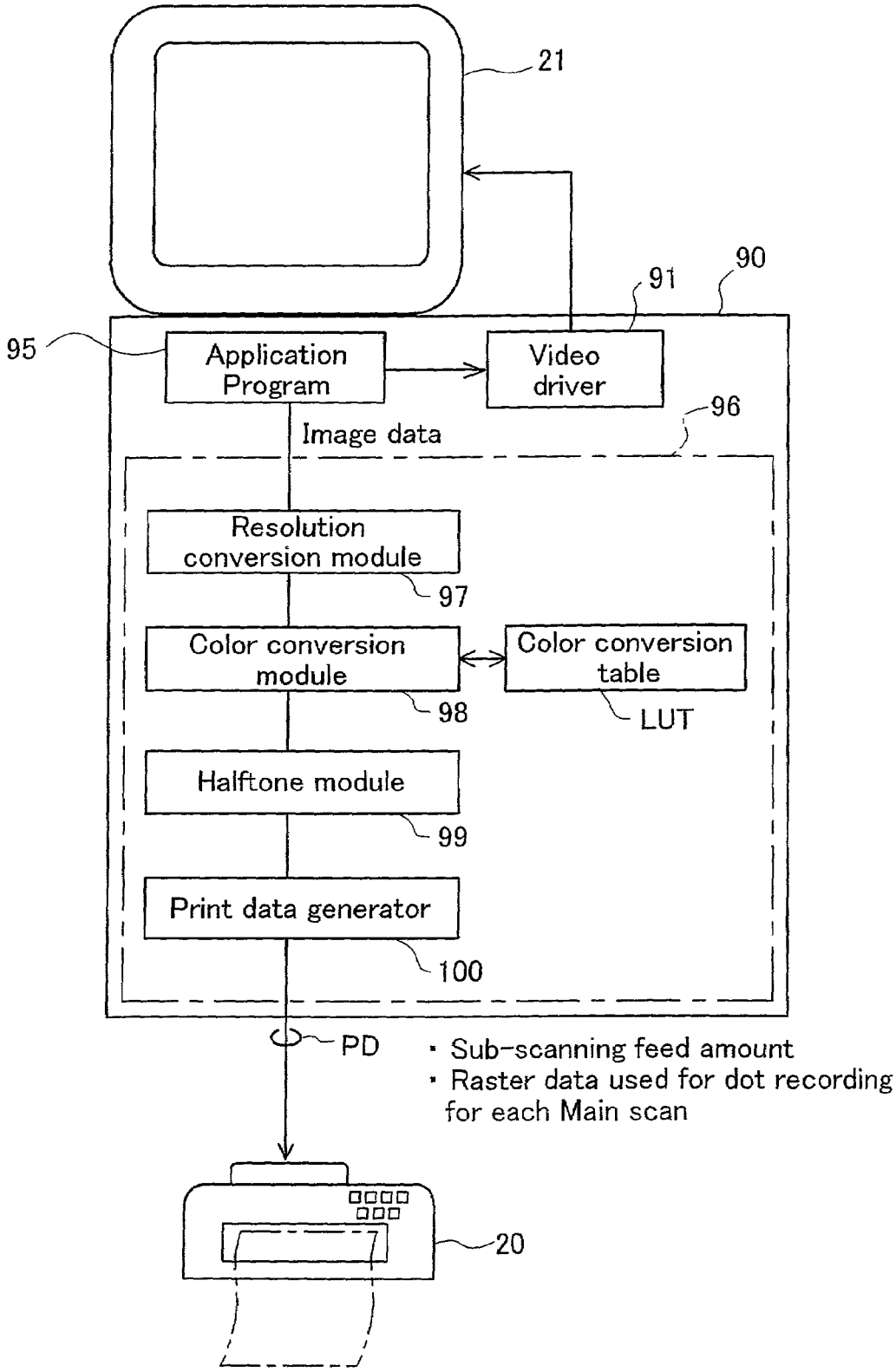
FIG. 1 is a block diagram depicting the structure of a printing system as an embodiment of the present invention.

FIG. 1 is a block diagram depicting the structure of a printing system as an embodiment of the present invention. The printing system comprises a computer 90 as a print control device, and a color printer 20 as a printing unit. A combination of the color printer 20 and computer 90 constitute a printing apparatus in a broader sense.

In the computer 90, an application program 95 is executed under a specific operating system. The operating system contains a video driver 91 and a printer driver 96, and the application program 95 outputs the print data PD to be transmitted to the color printer 20 via the se drivers. The application program 95 processes images and displays the images on a CRT 21 with the aid of the video driver 91.

When the application program 95 issues a print command, the printer driver 96 receives image data from the application program 95 and converts the se data to the print data PD to be supplied to the color printer 20. In the example shown in FIG. 1, the printer driver 96 contains a resolution conversion module 97, a color conversion module 98, a halftone module 99, a print data generator 100, and a color conversion table LUT.

The role of the resolution conversion module 97 is to convert the resolution of the color image data handled by the application program 95 (that is, the number of pixels per unit length) into a resolution that can be handled by the printer driver 96. The image data converted in terms of resolution in this manner are still in the form of image information composed of RGB color components. The color correction module 98 converts the RGB data in individual pixels into multilevel data suitable for a plurality of ink colors and usable by the color printer 20 while referring to the color correction table LUT.

The color-corrected multilevel data may, for example, have 256 gradations. The halftone module 99 executes a halftone routine to allow the color printer 20 to represent the multilevel gradations as dispersed ink dots. The halftoned image data are rearranged by the print data generator 100 according to a sequence in which the data are sent to the color printer 20, and are outputted as final print data PD. The print data PD comprise raster data for specifying a dot formation state at each pixel during main scanning, and data for specifying sub-scan feeds.

The printer driver 96 is a program for performing functions to generate print data PD. The program of the printer driver 96 can be supplied to users in the form of a computer-readable storage medium storing the same. Examples of such storage media include floppy disks, CD-ROMs, magnetooptical disks, IC cards, ROM cartridges, punch cards, printed matter with bar codes and other printed symbols, internal computer storage devices (RAM, ROM, and other types of memory), external storage devices, and various other computer-readable media.

Figure 2:
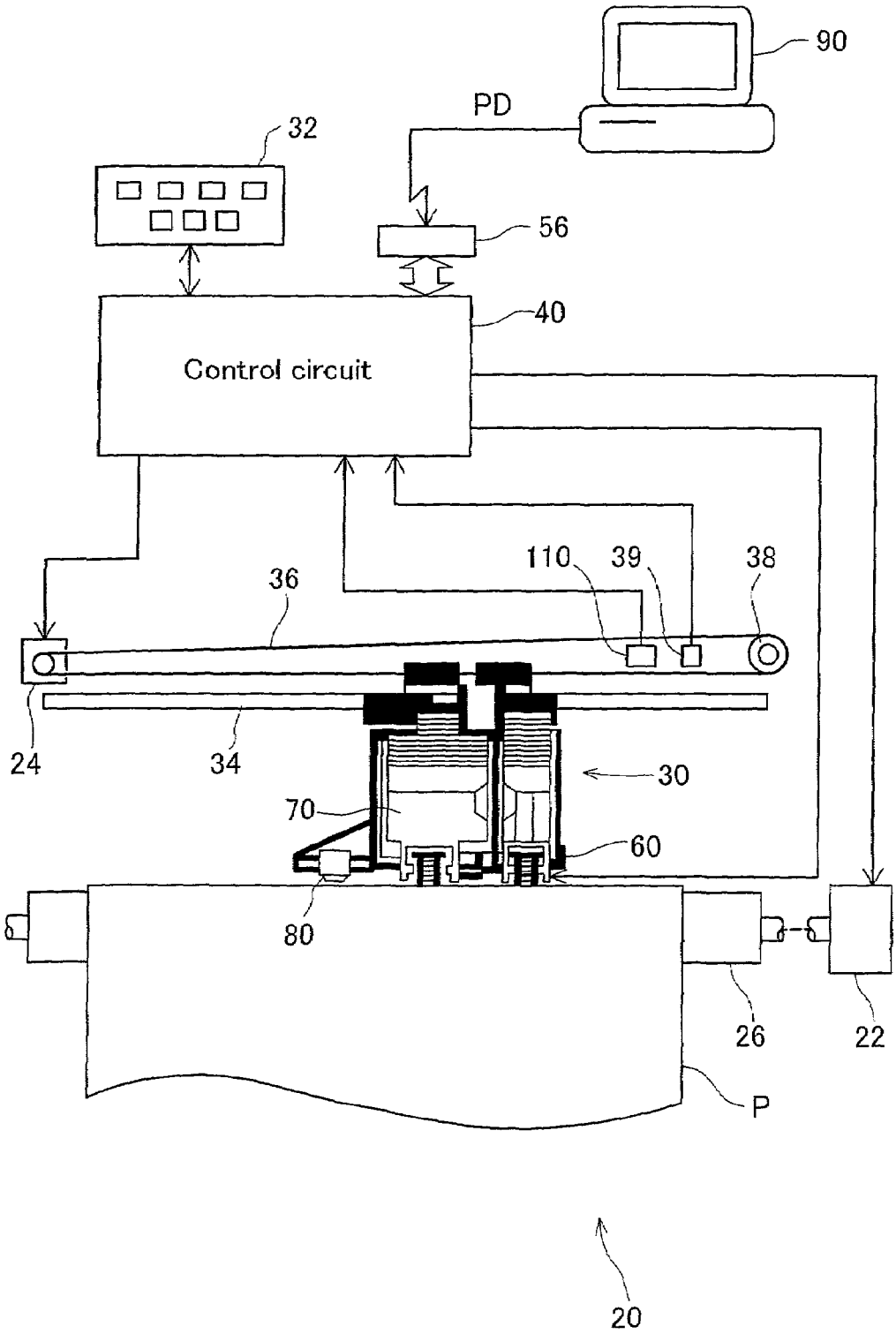
FIG. 2 is a diagram depicting the printer structure.

FIG. 2 is a schematic structural drawing of the color printer 20. The color printer 20 comprises a sub-scanning mechanism for transporting printing paper P in the direction of sub-scanning with the aid of a paper feed motor 22; a main scanning mechanism for reciprocating a carriage 30 in the axial direction (direction of main scanning) of a platen 26 with the aid of a carriage motor 24; a head drive mechanism for actuating a print head unit 60 (also referred to as a "print head assembly") mounted on the carriage 30 and controlling ink ejection and dot formation; and a control circuit 40 for exchanging signals between the paper feed motor 22, the carriage motor 24, the print head unit 60, and a control panel 32. The control circuit 40 is connected to the computer 90 by a connector 56.

The sub-scanning mechanism for transporting the printing paper P is provided with a gear train (not shown) for transmitting the rotation of the paper feed motor 22 to the platen 26 and a paper feed roller (not shown). The main scanning mechanism for reciprocating the carriage 30 comprises a sliding shaft 34 mounted parallel to the axis of the platen 26 and designed to slidably support the carriage 30, a pulley 38 for extending an endless drive belt 36 from the carriage motor 24, and a position sensor 39 for sensing the original position of the carriage 30.

Figure 3:
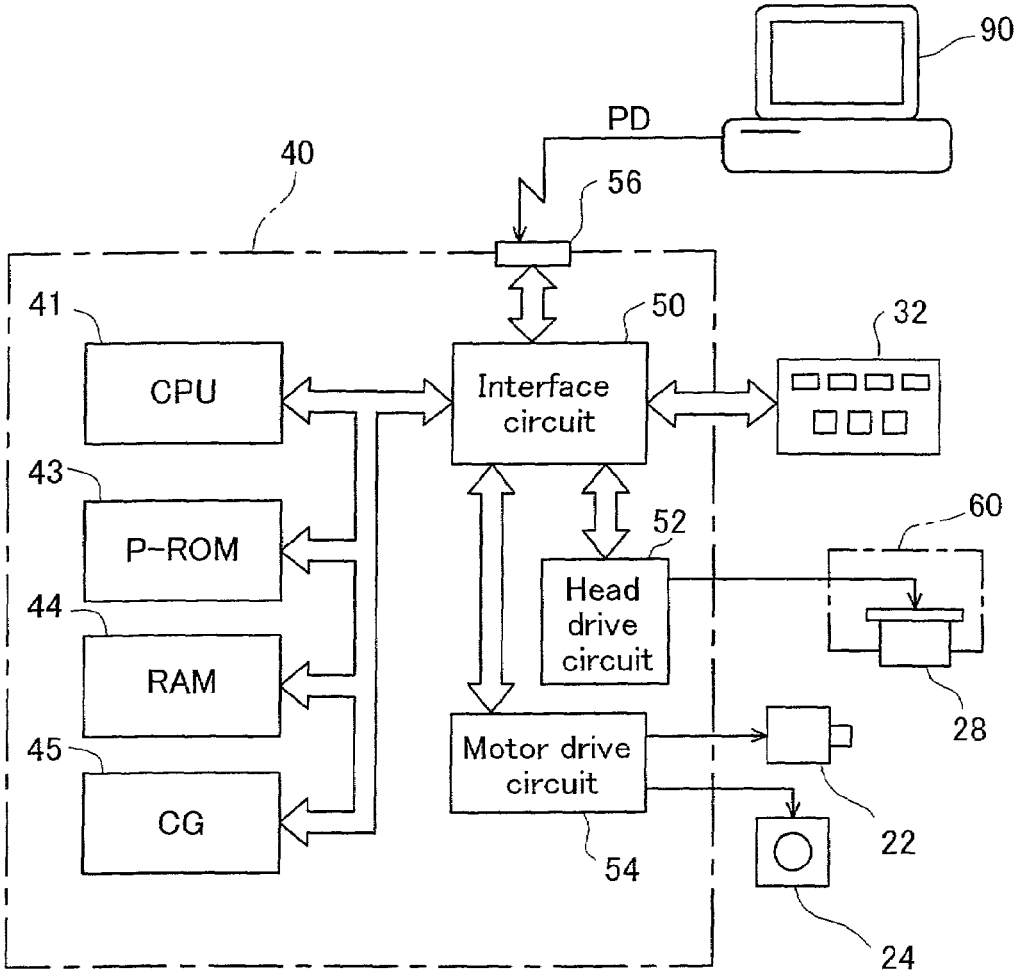
FIG. 3 is a block diagram depicting the structure of a color printer 20 based on a control circuit 40.

FIG. 3 is a block diagram depicting the structure of a color printer 20 based on the control circuit 40. The control circuit 40 comprises a CPU 41, a programmable ROM (PROM) 43, a RAM 44, and a character generator (CG) 45 containing dot matrices for characters. The control circuit 40 further comprises a I/F circuit 50 for creating a interface with external motors, a head drive circuit 52 connected to the I/F circuit 50 and designed to eject ink by actuating the print head unit 60, and a motor drive circuit 54 for actuating the paper feed motor 22 and carriage motor 24. The I/F circuit 50 contains a parallel interface circuit and is capable of receiving print data PD from the computer 90 via the connector 56. The color printer 20 prints images in accordance with the print data PD. RAM 44 functions as a buffer memory for the temporary storage of raster data.

The print head unit 60 has a print head 28 and is designed for mounting ink tanks. The print head unit 60 can be mounted on the color printer 20 and removed there from as a single component. In other words, the print head unit 60 is replaced when the print head 28 needs to be replaced.

Figure 4:
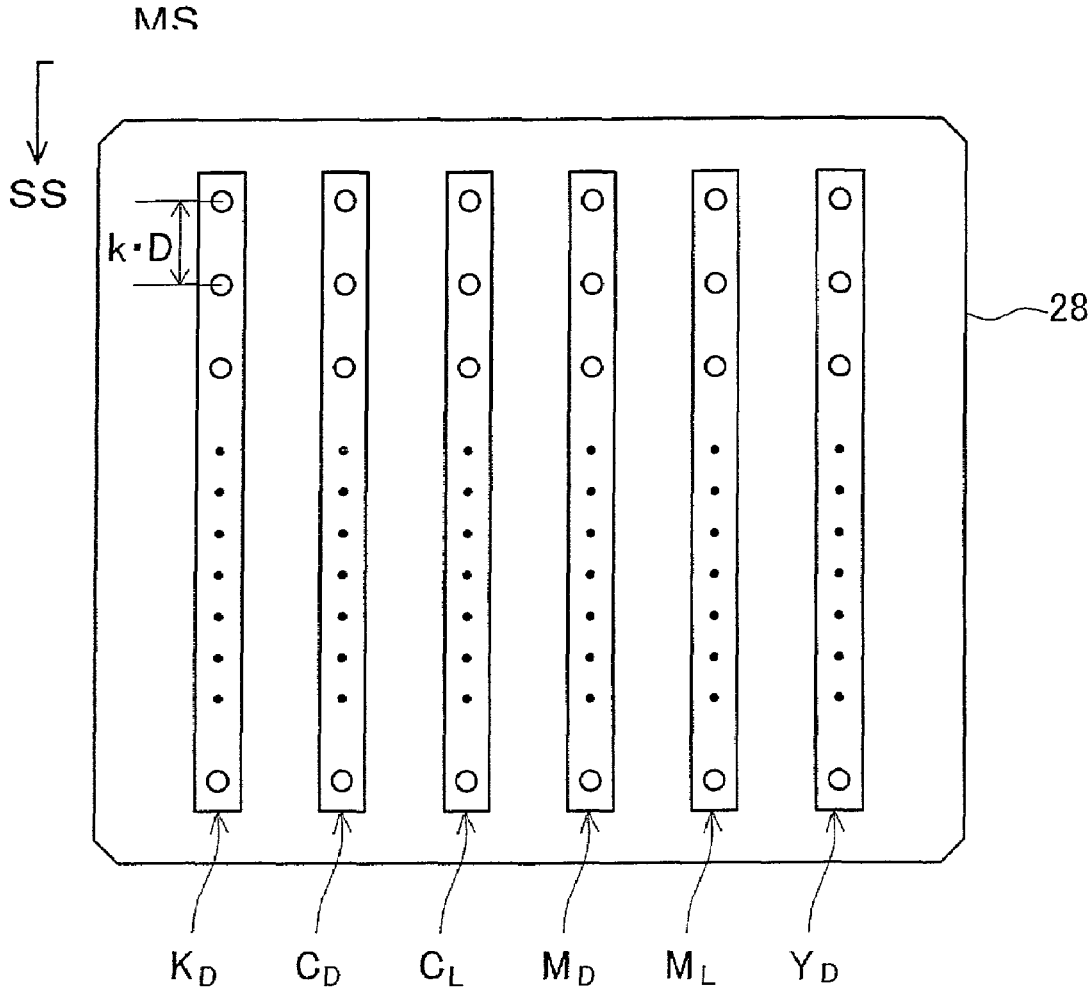
FIG. 4 is a diagram depicting the arrangement of nozzles on the bottom surface of a print head 28.

FIG. 4 is a diagram depicting the arrangement of nozzles on the bottom surface of the print head 28. The bottom surface of the print head 28 is provided with a black ink nozzle array $K_D$ for ejecting black ink, a dark cyan ink nozzle array $C_D$ for ejecting dark cyan ink, a light cyan ink nozzle array $C_L$ for ejecting light cyan ink, a dark magenta ink nozzle array $M_D$ for ejecting dark magenta ink, a light magenta ink nozzle array $M_L$ for ejecting light magenta ink, and a yellow ink nozzle array $Y_D$ for ejecting yellow ink.

The first capital letter in the symbol designating each nozzle array refers to the ink color, with the suffix "$_D$" designating a comparatively dense ink, and the suffix "$_L$" designating a comparatively light ink.

The nozzles of each nozzle array are disposed in the direction of sub-scanning SS at a constant nozzle pitch k·D, where k is an integer and D is a pitch (also referred to as a "dot pitch") that corresponds to the print resolution in the direction of sub-scanning. The phrase "the nozzle pitch is equal to k dots" will also be used in this specification. The corresponding dot unit refers to the dot pitch of print resolution. The dot unit will be used in the same manner with respect to the sub-scan feed amounts.

Each nozzle is provided with a piezoelectric element (not shown) as a drive element designed to actuate the nozzle and to eject ink drops. During printing, ink drops are ejected from each nozzle while the print head 28 is moving in the direction of main scanning MS.

The nozzle of each nozzle array may, for example, be arranged in a staggered configuration rather than being aligned in a straight line in the direction of sub-scanning. When the nozzles are arranged in a staggered configuration, the nozzle pitch k·D in the direction of sub-scanning can still be defined in the same manner as in FIG. 4. As used herein, the term "a plurality of nozzles arranged in the direction of sub-scanning" is used in a broad sense and includes cases in which the nozzles are arranged in a straight line and cases in which the nozzles are arranged in a staggered configuration.

The color printer 20 whose hardware is configured in the above-described manner operates such that the carriage 30 is reciprocated by the carriage motor 24, and the piezoelectric element of the print head 28 are actuated to eject ink drops at the same time. The ink drops of each color are ejected to form ink dots and to form multicolored gray-scale images on the paper P.

Figure 5:
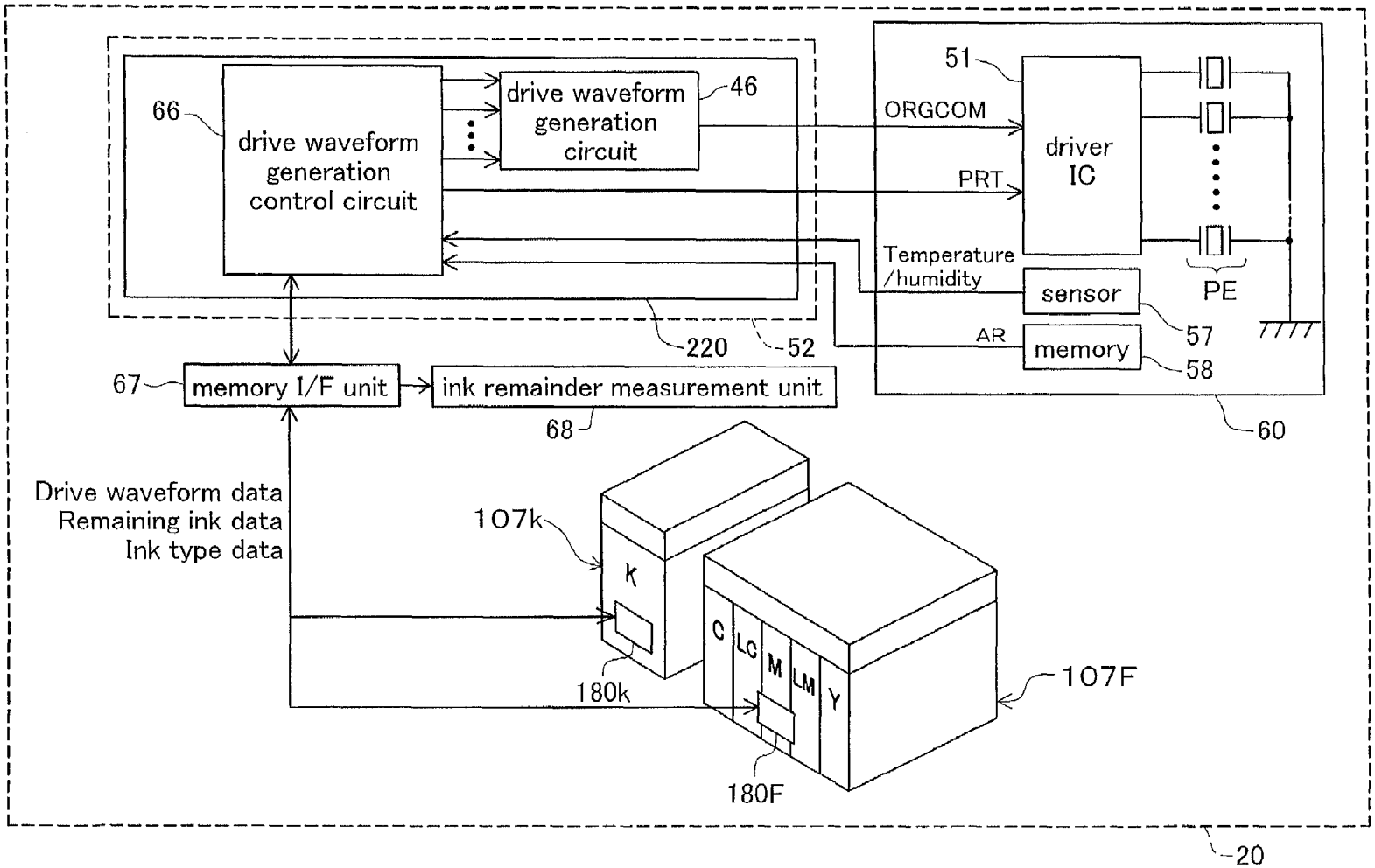
FIG. 5 is a block diagram depicting the interior structure of a circuit for feeding drive signals to each piezoelectric element.

FIG. 5 is a block diagram depicting the interior structure of a circuit for feeding drive signals to each piezoelectric element. The head drive circuit 52 comprises an original drive signal generator 220 for generating original drive signals ORGDRV. The original drive signal generator 220 comprises one or more drive waveform generation circuits 46 and a drive waveform generation control circuit 66 for controlling the drive waveform generation circuits 46.

The print head unit 60 has a driver IC 51 for feeding drive signals to piezoelectric element PE. The driver IC 51 has a switching circuit (not shown; also referred to as a "mask circuit") for on/off controlling the original drive signals ORGDRV from the drive waveform generation circuits 46 in accordance with serial print signals PRT from the drive waveform generation control circuit 66. The serial print signals PRT are formed in accordance with the levels of the raster data contained in the print data PD from the computer 90 (FIG. 1).

Memories 180*k* and 180F are provided on a black ink cartridge 107*k* and a color ink cartridge 107F, respectively. The memories 180*k* and 180F store information on the types of inks contained in the ink cartridges 107*k* and 107F, the drive waveform data used in the generation of drive waveforms, and information on the residual amount of ink in the tanks. Nonvolatile memories are used for the memories 180*k* and 180F in order to store information on the remaining ink.

The color ink cartridge 107F is a combination of five ink tanks designed for five types of ink. The ink cartridge 107F can be replaced with a print head unit 60 configured to allow ink tanks used separately for each type of ink to be mounted on the print head unit 60. In this arrangement, each ink tank has a memory. It follows from this description that the term "ink tank" used herein refers to a container designed to store a single type of ink. In addition, the term "ink cartridge" refers to a monolithically formed container having at least one ink tank.

As can be seen in FIG. 5, the contents of the memories 180*k* and 180F of the ink cartridges 107*k* and 107F can be read by the drive waveform generation control circuit 66 and an ink remainder measurement unit 68 through the agency of a memory interface unit 67 in the control circuit 40 (FIG. 3) of the printer 20. The ink remainder measurement unit 68 may be implemented by a computer program stored in the PROM 43 and executed by the CPU 41 (FIG. 3) in the control circuit 40. The drive waveform generation control circuit 66 uses drive waveform data obtained from the memories 180*k* and 180F to allow the drive waveform generation circuits 46 to generate drive waveforms suitable for the ink stored in the ink cartridges. The drive waveform data read from the memories 180*k* and 180F can be corrected in accordance with the remainder of each type of ink measured by the ink remainder measurement unit 68. The ink remainder measurement unit 68 corresponds to a calculating unit in the claims.

B. Embodiments

Figures 6A, 6B:
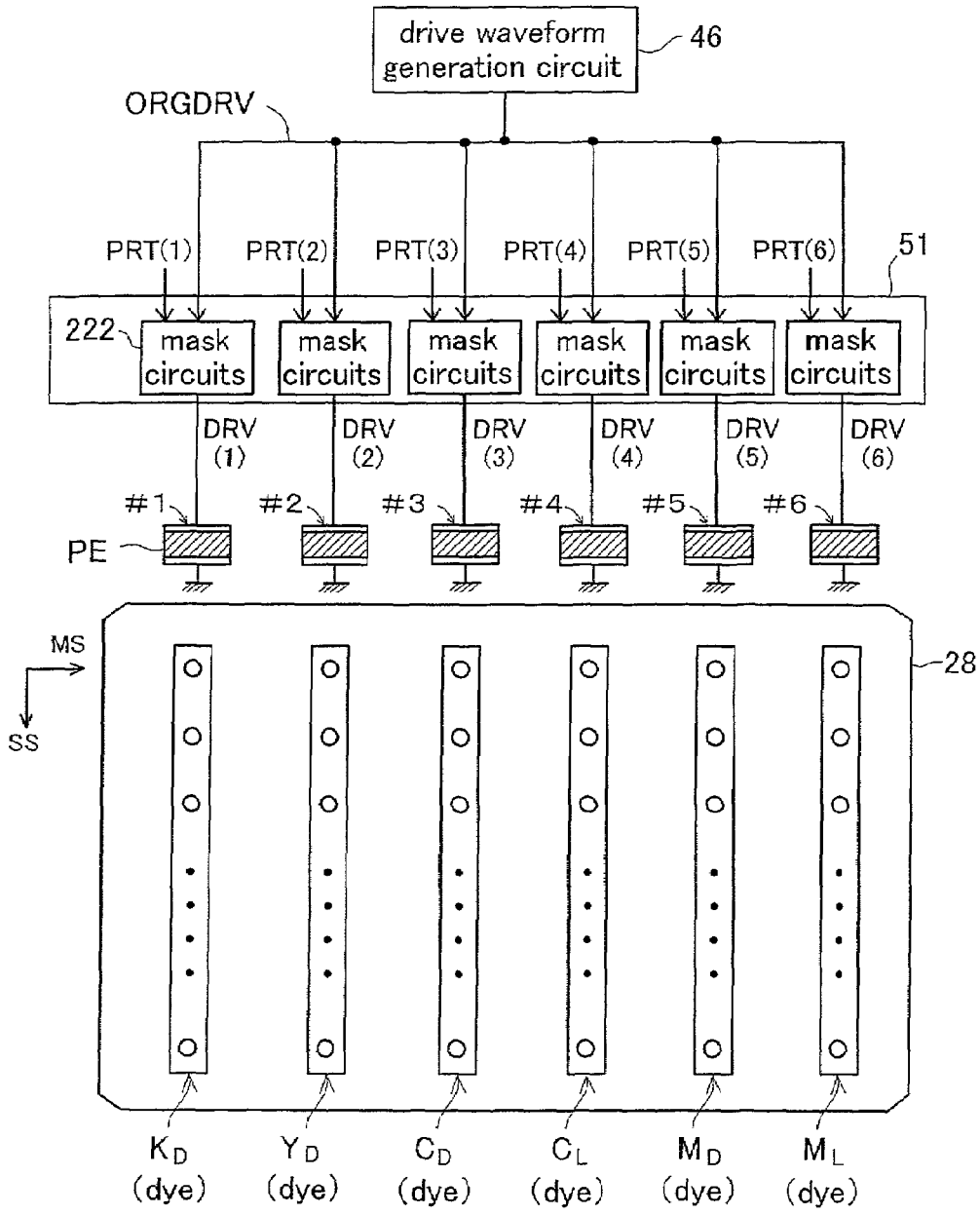
FIG. 6(*a*) is a diagram depicting the structure of a drive circuit for a print head 28 pertaining to a first embodiment of the present invention.

FIG. 6(*a*) is a diagram depicting the structure of a drive circuit for a print head 28 pertaining to a first embodiment of the present invention. According to the first embodiment, a single drive waveform generation circuit 46 is provided as a common unit to all the nozzle arrays. An original drive signal ORGDRV generated by each drive waveform generation circuit 46 is turned on and off by a mask circuit 222 in the driver IC 51 in accordance with a print signal PRT, thereby generating a drive signal DRV for each nozzle. The mask circuit 222 presents the drive signal DRV to the piezoelectric element PE of each nozzle. The piezoelectric elements PE are thus actuated, ink is ejected from the nozzles, and ink dots are formed on the print medium.

FIG. 6(*b*) is a diagram illustrating the contents of data stored in the memories 180*k* and 180F provided to the ink cartridge. According to the first embodiment, at least one of the memories 180*k* and 180F contains ink type data, drive waveform data, and mask data. As used herein, the term "ink type data" refers to data that represent an ink type, for example, whether the ink stored in each ink tank is a dye ink or a pigment ink. The term "drive waveform data" refers to the data that defines the shape of the drive waveform generated by the drive waveform generation circuit 46. The term "mask data" refers to data that represent various patterns of the serial print signal PRT (FIG. 6(*a*)) in accordance with the values of the raster data. In other words, the drive waveform generation control circuit 66 selects one type of data from the plurality of types of mask data in accordance with the values of the raster data, and outputs the selected mask data as a serial print signal PRT.

According to the first embodiment, all the ink tanks thus mounted contain dye inks, so each nozzle ejects a dye ink, as shown in FIG. 6(*a*). Meanwhile, the memories 180*k* and 180F contain drive waveform data suitable for ejecting the dye ink, as shown in FIG. 6(*b*). The drive waveform data are presented to the drive waveform generation control circuit 66 through the agency of the memory interface unit 67, and the drive waveform generation circuit 46 generates an original drive signal ORGDRV suitable for ejecting the dye ink on the basis of these data.

The memory 180*k* and/or the memory 180F contain drive waveform data and mask data for pigments when all six inks are pigments.

Figures 7A, 7B:
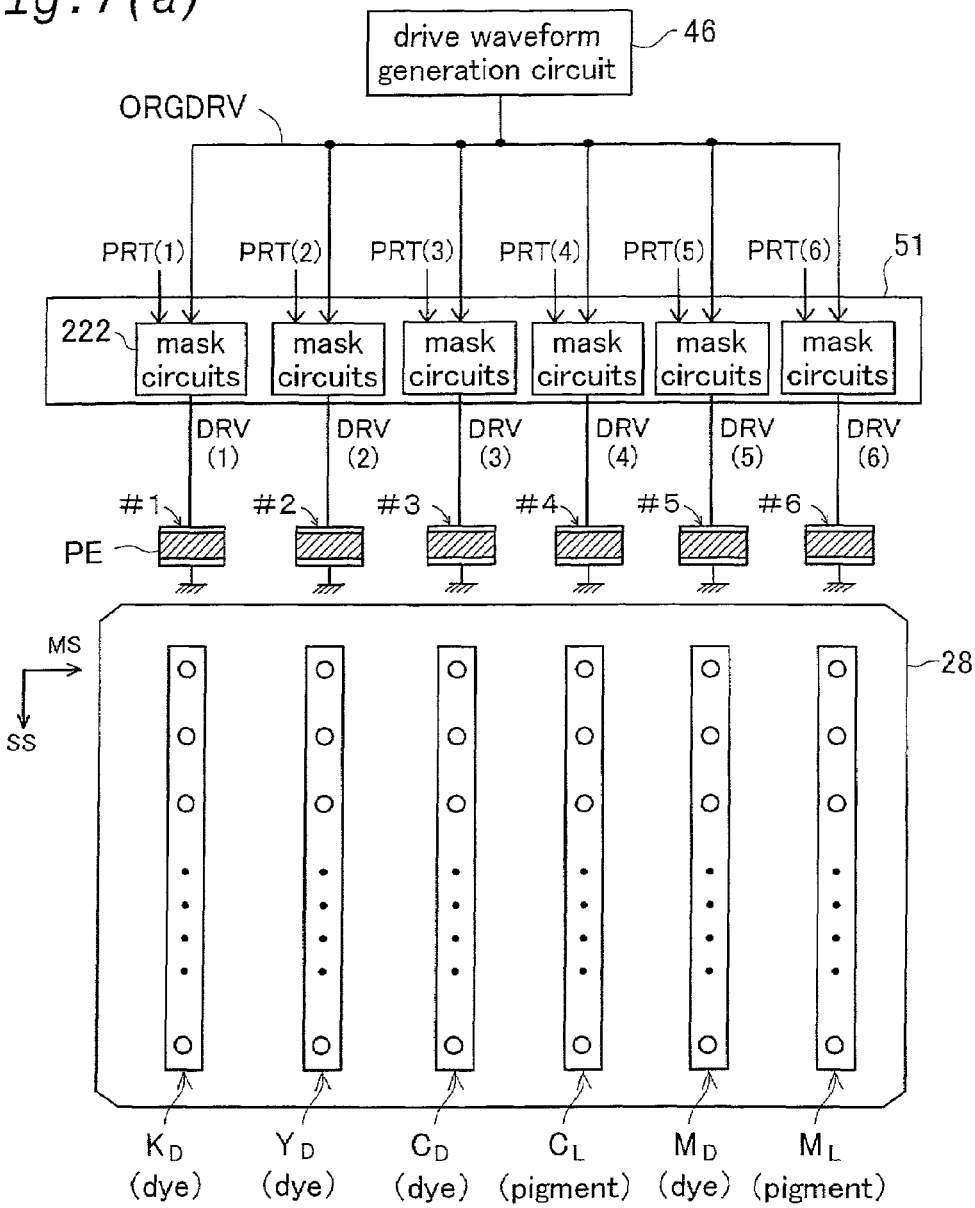
FIG. 7(*a*) is a diagram depicting the structure of the drive circuit for the print head 28 pertaining to the first embodiment of the present invention.

FIGS. 7(*a*) and 7(*b*) depict a case in which the light cyan ink $C_L$ and the light magenta ink $M_L$ are pigments, and the other four inks are dyes. In this case, a set of drive waveform data for dye/pigment combinations capable of allowing both dye and pigment inks to be adequately ejected are stored as drive waveform data in the memories 180*k* and 180F. The same applies to mask data.

It follows from the above examples that it is possible to operate a printing apparatus by employing ink tanks containing various types of ink if a procedure is adopted in which the memories of the ink tanks are provided with drive waveform data suitable for ejecting the inks contained therein. When, for example, a new type of ink is developed after the printer has been shipped, and a drive signal must be generated using an optimal drive waveform for ink ejection, this drive waveform can still be used for printing. Even in this case, the mask data may be common data applicable to any ink type.

Figure 8:
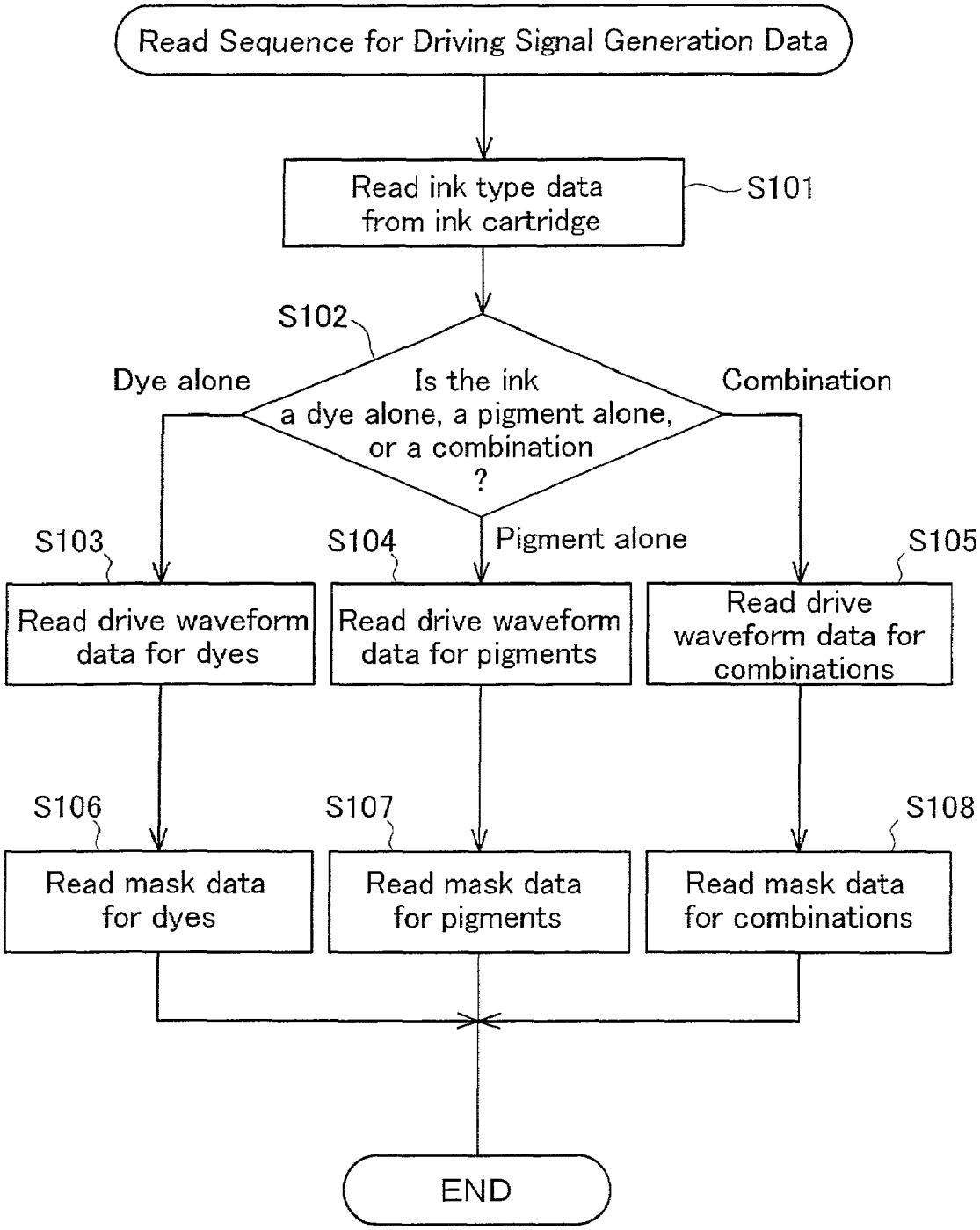
FIG. 8 is a flowchart depicting a procedure in which data for generating drive signals are read into an original drive signal generator.

FIG. 8 is a flowchart depicting a procedure in which data for generating drive signals are read into the head drive circuit 52. In step S101, the head drive circuit 52 reads ink type data from the memory of each ink cartridge. In step S102, the head drive circuit 52 collects the ink type data from all the cartridges and determines whether only dye inks, only pigment inks, or combinations of dye and pigment inks are used. In the example shown in FIGS. 6(*a*) and 6(*b*), it is determined that dye inks alone are used, and the operation proceeds to step S103. Drive waveform data for dyes are read in step S103, and mask data for dyes are read in step S106. The mask data for dyes are prepared based on the drive waveform for dyes obtained in step S103. If it is determined that pigment inks alone are used, the operation proceeds to step S104, drive waveform data for pigments are read in step S104, and mask data for pigments are read in step S107. Similarly, the operation proceeds to step S105, the drive waveform data for combinations are read in step S105, and the mask data for combinations are read in step S108 if it is determined that ink combinations are used.

Figure 9A:
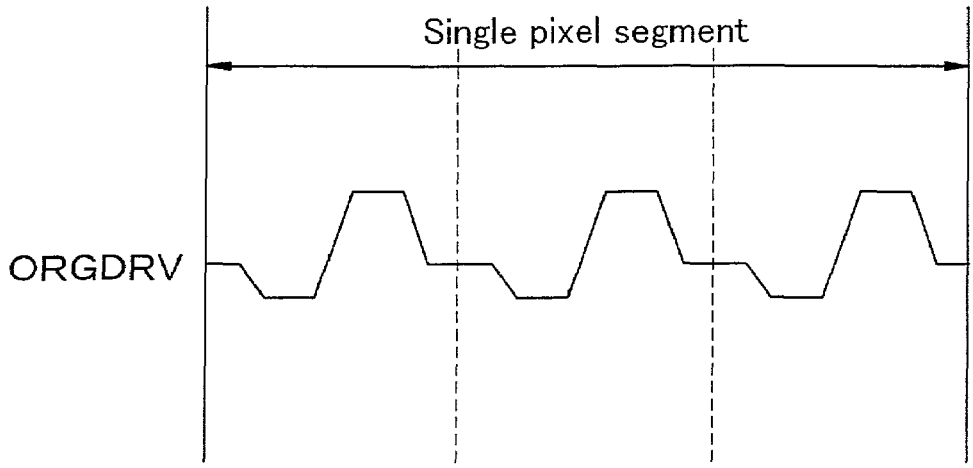
FIG. 9(*a*) is a diagram depicting appropriate drive waveforms for dye ink.
Figure 9B:
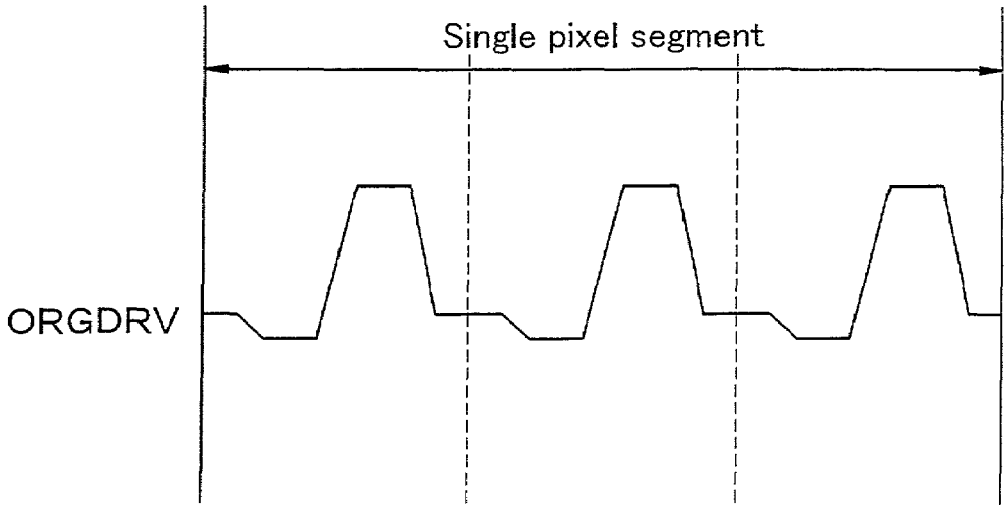

FIGS. 9(*a*) and (*b*) are diagrams depicting the relation between ink types and the drive waveforms suitable there for. FIG. 9(*a*) depicts a drive waveform suitable for a specific dye ink, and FIG. 9(*b*) depicts a drive waveform suitable for a specific pigment ink. As pointed out above, a dye ink tends to spread or bleed across a print medium, whereas a pigment ink resists spreading or bleeding across a print medium. Dots formed on a print medium will therefore vary in size if ink drops are ejected onto the print medium in substantially equal amounts. Consequently, drive waveforms must be varied in order to obtain dots of the same size. As a result, a drive waveform with a smaller amplitude is used for dye inks, and a larger drive waveform is used for pigment inks, as shown in FIGS. 9(*a*) and 9(*b*).

Figure 10B:
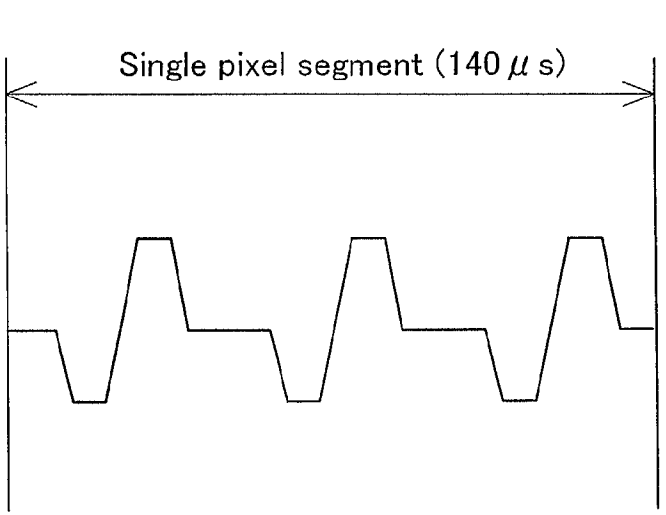
FIGS. 10(*a*) and 10(*b*) are diagrams depicting an example of drive waveform data.
Figure 10A:
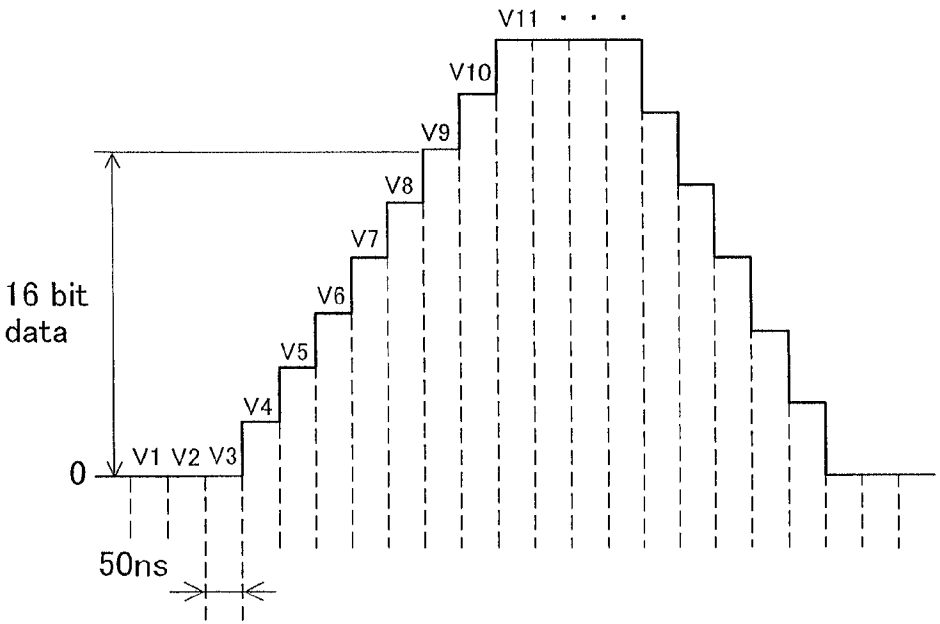

FIGS. 10(*a*) and 10(*b*) are diagrams depicting an example of drive waveform data. According to the first embodiment, the memory 180 stores drive waveforms (which are inherently analog data) as sets of sample values for each 50-ns sample cycle, as shown in FIG. 10(*a*). Specifically, this example is configured such that drive waveforms are displayed using a system in which the potentials (V1–Vn) of sample values for every 50 ns are aligned as 16-bit data packets in a chronological series. Sampled data for a single pixel segment (140 μs) are stored as drive waveform data in the memory 180 for the entire sample, as shown in FIG. 10(*b*). The total size of these data is 44.8 kilo bits. This is because the size of data is the product of a single sample value (16 bits) and the number of samples (140 μs÷50 ns=2800). In the present specification, these data will be referred to as "drive waveform sample value data."

Figure 11B:
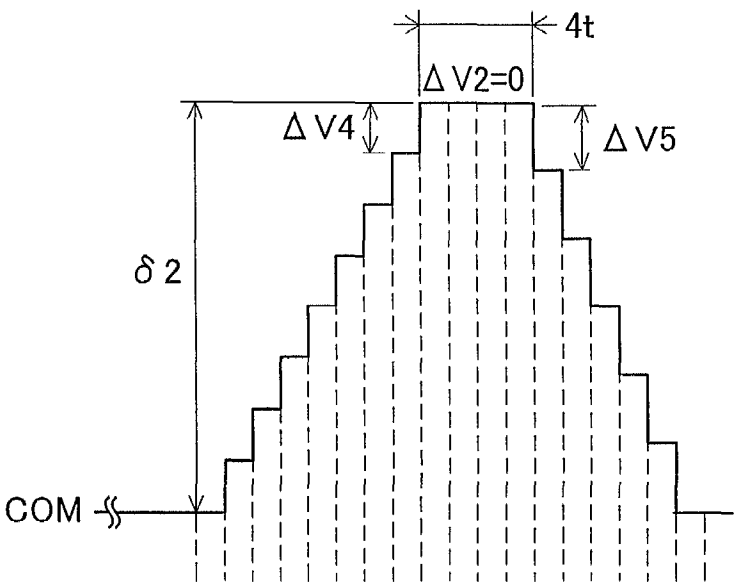
FIGS. 11(*a*) and 11(*b*) are diagrams depicting another example of drive waveform data.
Figure 11A:
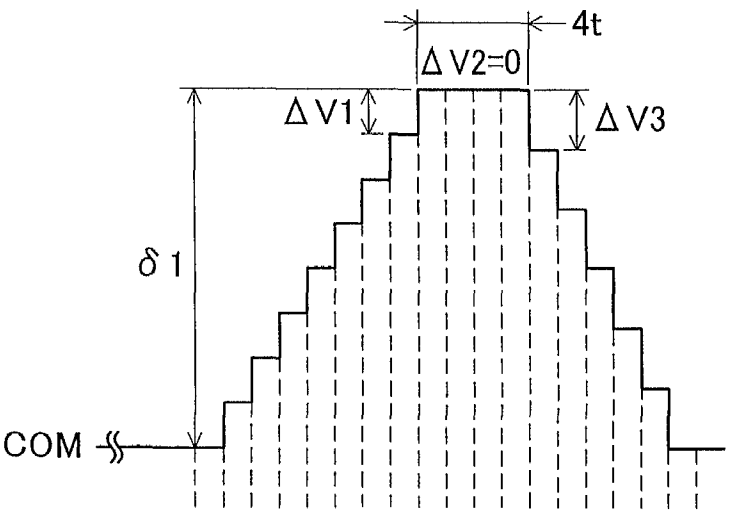

FIGS. 11(*a*) and 11(*b*) are diagrams depicting another example of drive waveform data and a method for correcting the same. Drive waveforms can be generated as drive waveform data on the basis of ΔV1–ΔVn (where n is a natural number), which show the change in potential for each specific clock signal, and on the basis of the timing data for their switching, as shown in FIG. 11(*a*). For example, a high voltage level can be changed from δ1 shown in FIG. 11(*a*) to δ2 shown in FIG. 11(*b*) by changing the data from ΔV1 to ΔV4 during a potential increase and changing the data from ΔV3 to ΔV5 during a potential decrease. In addition, the time of the high voltage level can be varied by varying the timing with which the data are changed from ΔV2=0 to ΔV5. In the present specification, such data are referred to as "drive waveform element data."

FIGS. 12(*a*)–12(*g*) are time charts depicting a method for reshaping an original drive signal ORGDRV by a serial print signal PRT(i) to generate a drive signal DRV in accordance with the first embodiment of the present invention. The original drive signal ORGDRV of the present embodiment contains three types of pulses W1–W3 with different waveforms for the three sub-segments of a single pixel segment, as shown in FIG. 12(*a*). The amplitude of the pulses W1–W3 increase in the following sequence: second pulse W2, first pulse W1, and third pulse W3.

FIGS. 12(*b*)–12(*d*) depict the serial print signals PRT(i) for small, medium, and large dots, respectively. A serial print signal PRT(i), which assumes an "H" or "L" state in each sub-segment of a pixel segment, is generated based on the mask data that are read from the memory 180. According to the first embodiment, the serial print signal for small dots (FIG. 12(*b*)) assumes an "H" state in the second sub-section, the serial print signal for medium dots (FIG. 12(*c*)) assumes an "H" state in the first sub-section, and the serial print signal for large dots (FIG. 12(*d*)) assumes an "H" state in the third sub-section. The mask circuit 222 transmits the original drive signal ORGDRV when the serial print signal is in the "H" state, thereby generating a drive signal DRV. Although this is not shown in the drawings, a serial print signal corresponding to the absence of dots assumes an "L" state throughout the entire pixel segment.

FIGS. 12(*e*)–12(*g*) depict the resulting drive signals DRV (i). As described above, a drive signal DRV(i) has the same waveform as the original drive signal ORGDRV only when the serial print signal PRT(i) is in the "H" state. Consequently, a drive signal for small dots (FIG. 12(*e*)) generated in the case of a dye ink contains a second small pulse W2, a drive signal for medium dots (FIG. 12(*f*)) contains a first medium pulse W1, and a drive signal for large dots (FIG. 12(*g*)) contains a third large pulse W3.

Drive signals DRV suitable for a dye ink can be generated on the basis of the ink type data, drive waveform data for dye inks, and mask data for dye inks obtained from the memory provided to the ink tank, as described above. The same applies to cases in which all the inks are pigments.

Figures 13A, 13B:
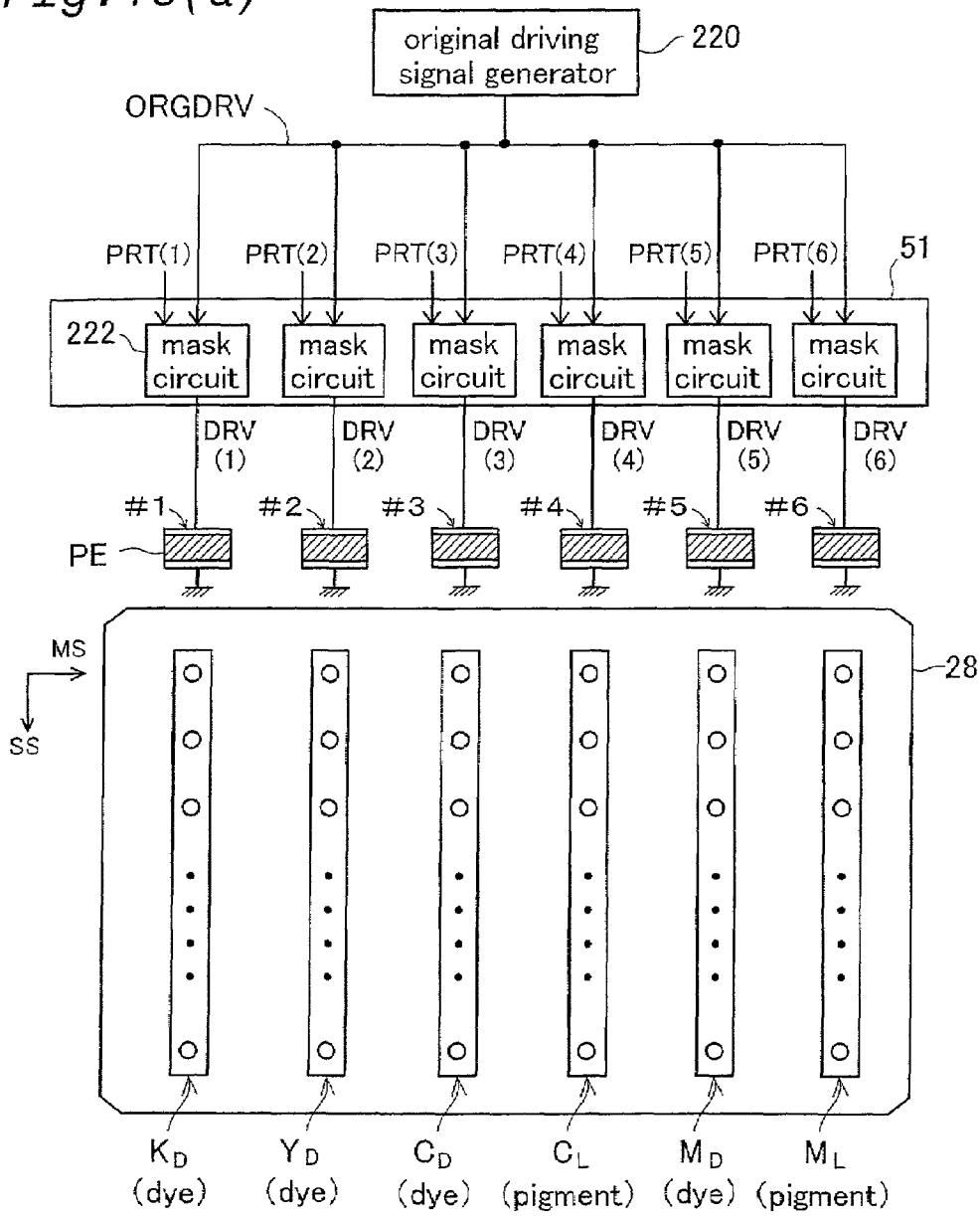
FIG. 13(*a*) is a diagram depicting the structure of a drive circuit for a print head 28 pertaining to a second embodiment of the present invention.

FIG. 13(*a*) is a diagram depicting the structure of a drive circuit for a print head 28 pertaining to a second embodiment of the present invention. The structure of the drive circuit and the ink types are the same as those described above with reference to FIG. 7(*a*). The only difference of the present circuit from the one shown in FIGS. 7(*a*) and 7(*b*) is that two types of mask data, that is, mask data for dyes and mask data for pigment inks, are stored in the memories 180*k* and 180F, as shown in FIG. 13(*b*).

FIGS. 14(*a*)–14(*g*) and 15(*a*)–15(*g*) are timing charts depicting the operation of the interior components of the head drive circuit according to the second embodiment. FIGS. 14(*a*)–14(*g*), which is similar to FIGS. 12(*a*)–12(*g*), is a timing chart related to the ejection of a dye ink. FIGS. 15(*a*)–15(*g*) are timing charts related to the ejection of a pigment ink.

The difference between ejecting of a dye ink and that of a pigment ink lies in the serial print signal PRT(i) for large dots (FIGS. 14(*d*), 15(*d*)). Specifically, the serial print signal for large dots (FIG. 14(*d*)) related to the ejection of a dye ink assumes an "H" state in the third sub-segment, whereas the serial print signal for large dots (FIG. 15(*d*)) related to the ejection of a pigment ink assumes an "H" state in the second and third sub-segments.

FIGS. 14(*e*)–14(*g*) and 15(*e*)–15(*g*) depict the resulting drive signals DRV(i). As described with reference to the first embodiment, a drive signal DRV(i) has the same waveform as the original drive signal ORGDRV only when the serial print signal PRT(i) is in the "H" state. Consequently, a drive signal for large dots of dye ink (FIG. 14(*g*)) contains a third large pulse W3. By contrast, a drive signal for large dots of pigment ink (FIG. 15(*g*)) contains two types of pulses: a second small pulse W2 and a third large pulse W3. As a result, the large dots of pigment ink can be formed in substantially the same size as the large dots of dye ink.

Although the present embodiment was described with reference to the use of an original drive signal ORGDRV containing three types of pulses (W1–W3) within a single pixel segment, it is also possible to use an original drive signal containing four types of pulses (obtained by adding an even bigger, fourth pulse) within a single pixel segment. Adopting this arrangement makes it possible to generate a drive signal for large dots in the case of pigment ink by making use of the fourth pulse alone.

It is also possible to form dye and pigment inks into three types of dots (small, medium, and large) by employing an original drive signal ORGDRV containing four identical pulses W1–W4 within a pixel segment. For example, it is possible to form a small dot by means of a single pulse, a middle dot by means of two pulses, and a large dot by means of three pulses in the case of a dye ink, and a small dot by means of a single pulse, a middle dot by means of two pulses, and a large dot by means of four pulses in the case of a pigment ink.

FIG. 16(*a*) is a diagram depicting the structure of the drive circuit for a print head 28 pertaining to a third embodiment of the present invention. The third embodiment differs from the first and second embodiments in that the head drive circuit 52 has three drive waveform generation circuits 46*a*, 46*b*, and 46*c* and that the drive waveform generation circuits 46*a*, 46*b*, and 46*c* can generate mutually different drive waveforms.

According to the third embodiment, ink tanks are provided such that dye inks can be used for cyan $C_D$, magenta $M_D$ and yellow $Y_D$ inks, and pigment inks can be used for light cyan $C_L$ and light magenta $M_L$ inks.

FIG. 16(*b*) is a diagram depicting the contents of data stored in the memories 180*k* and 180F provided to the ink cartridge. The third embodiment is similar to the first and the second embodiments in that the memory 180*k* and/or the memory 180F stores ink type data, drive waveform data, and mask data. The head drive circuit 52 has three drive waveform generation circuits 46*a*–46*c*, making it possible to read drive waveform data that correspond to each ink when two or three types of ink are used.

Figure 17:
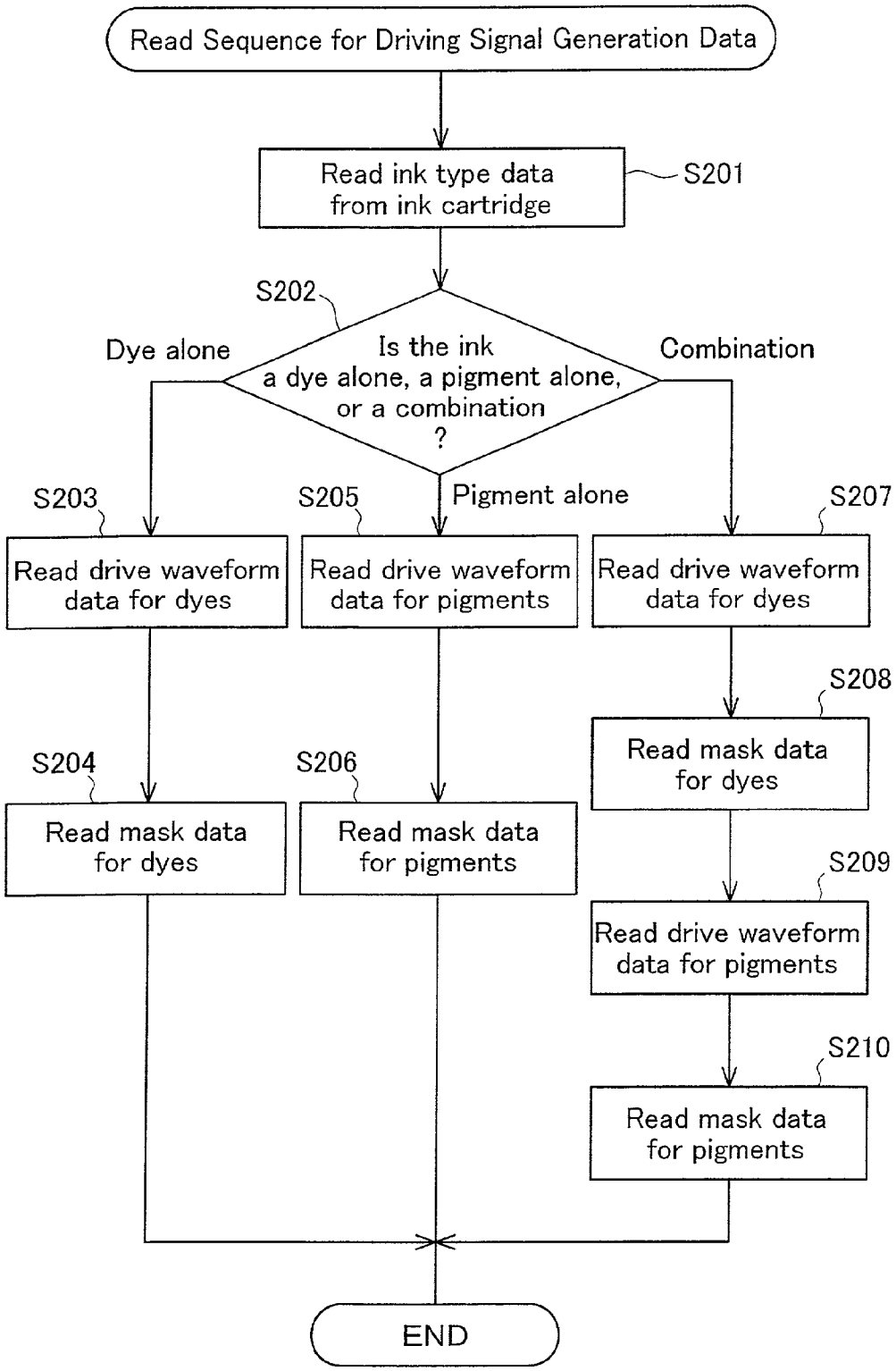
FIG. 17 is a flowchart depicting a procedure in which data for generating drive signals are read into an original drive signal generator.

FIG. 17 is a flowchart depicting the flow of a procedure in which data for generating drive signals are read into the drive waveform generation circuits 46 in accordance with the third embodiment of the present invention. In step S201, the head drive circuit 52 reads ink type data from the memory of each ink tank. In step S202, the head drive circuit 52 collects the ink type data from all the ink tanks and determines whether only dye inks, only pigment inks, or combinations of dye and pigment inks are used. In the present embodiment, it is determined that a combination is used because some of the mounted ink tanks contain a dye ink, and other ink tanks contain a pigment ink. In the third embodiment, the operation proceeds to step S207 because it has been determined that a combination is used. The following types of data are read: drive waveform data for dyes in step S207, mask data for dyes in step S208, drive waveform data for pigments in step S209, and mask data for pigments in step S210.

The drive waveform generation control circuit 66 specifies the drive waveform to be fed to each nozzle array on the basis of ink type data obtained from the memory of each ink tank. For example, the head drive circuit 52 establishes a connection for the drive waveform generation circuits 46 such that a drive signal for dye ink is fed to the nozzle array for ejecting black ink (which is a dye ink) and that a drive signal for pigment ink is fed to the nozzle array for ejecting light cyan ink (which is a pigment ink). Adopting this approach makes it possible to eject dye and pigment inks such that appropriate dots are formed on a print medium by means of signals based on drive waveforms suitable for dye inks and pigment inks, respectively.

C. Correction of Drive Waveforms

According to the embodiments described above, original drive signals ORGDRV are generated based on the information obtained from a memory provided to the ink tank, and these original drive signals ORGDRV can be further corrected. For example, a drive waveform can be corrected and image quality improved depending on the amount of ink remaining in the ink tank, the humidity, the temperature of the print head 28, or an actuator rank AR. As used herein, the term "actuator rank AR" refers to the rating or grade that expresses the characteristics of an ink-ejecting actuator and is preset by analyzing the actual characteristics of the actuator including actuator circuit (not shown) and piezoelectric element PE. In other words, it corresponds to an ejection characteristic rank used to for express the ink ejection characteristics of a print head. Adopting this approach makes it possible to prevent the actuator characteristics or the operating environment maintained during printing from having an adverse effect on dot formation.

Figure 18A:
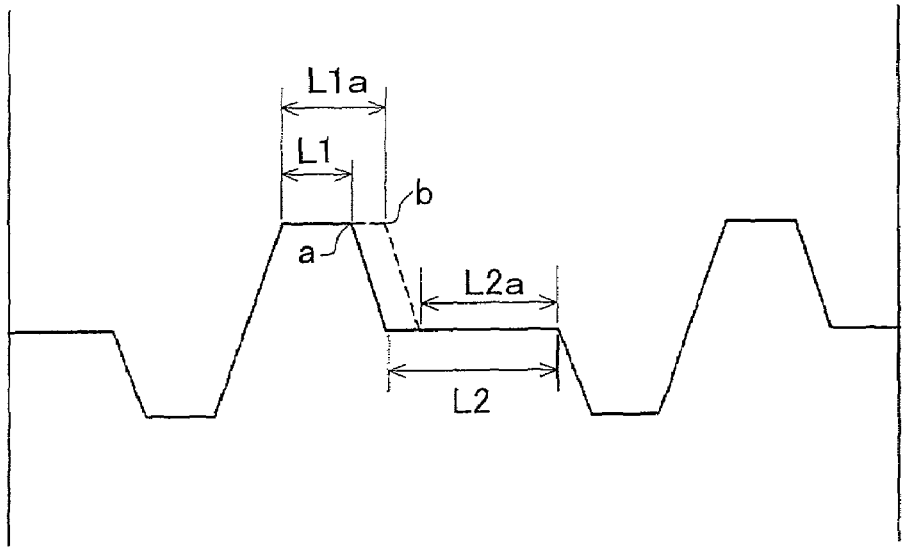
FIGS. 18(*a*) and 18(*b*) are diagrams depicting a method for correcting drive signals.
Figure 18B:
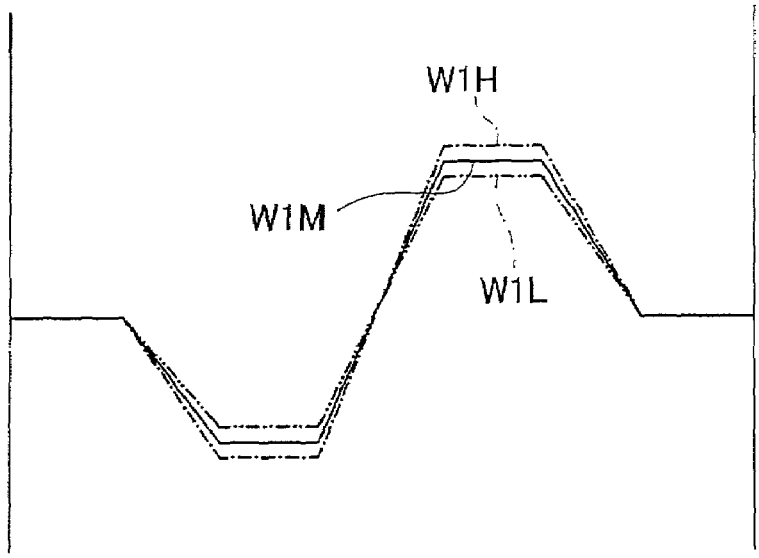

FIGS. 18(*a*) and 18(*b*) are diagrams depicting a method for correcting drive signals. FIG. 18(*a*) illustrates a method for correcting drive signals on the basis of the actuator rank AR. The actuator rank AR may, for example, have seven ratings (from 0 to 6), which determine the values of the width L1 for a high-voltage level and the width L2 for a zero level of a drive waveform. In the example shown in FIG. 18(*a*), the width L1 of the high-voltage level of a drive waveform is extended to L1*a*, and the width L2 of the zero level is contracted to L2*a*. No detailed description is given herein for the relation between the actuator rank AR and the waveform widths L1 and L2.

Correction specifics (for example, the width L1*a* of the high-voltage level) may be read from the memory provided to the ink tank. An appropriate correction customized for the desired ink type can thereby be made.

FIG. 18(*b*) is a diagram depicting a method for correcting a drive waveform on the basis of humidity, the temperature of the print head 28, or the amount of ink remaining in the ink tank. W1M is an uncorrected drive waveform, W1H is a drive waveform with an increased amplitude, and W1L is a drive waveform with a reduced amplitude. In other words, a correction might entail increasing or reducing the amplitude of the drive waveform. The amount of ink ejection tends to decrease with the amount of remaining ink in the tank, so the amplitude of the drive waveform is increased to compensate for reduction in the amount of ink ejection. Similarly, variations in temperature or humidity can be offset by varying the amplitude of the drive waveform to achieve a more stable print quality irrespective of temperature and other operating environment parameters. Corrections specifics (such as the extend of an increase) may be read from the memory provided to the ink tank. The method for measuring the amount of remaining ink will be described below.

Figure 19:
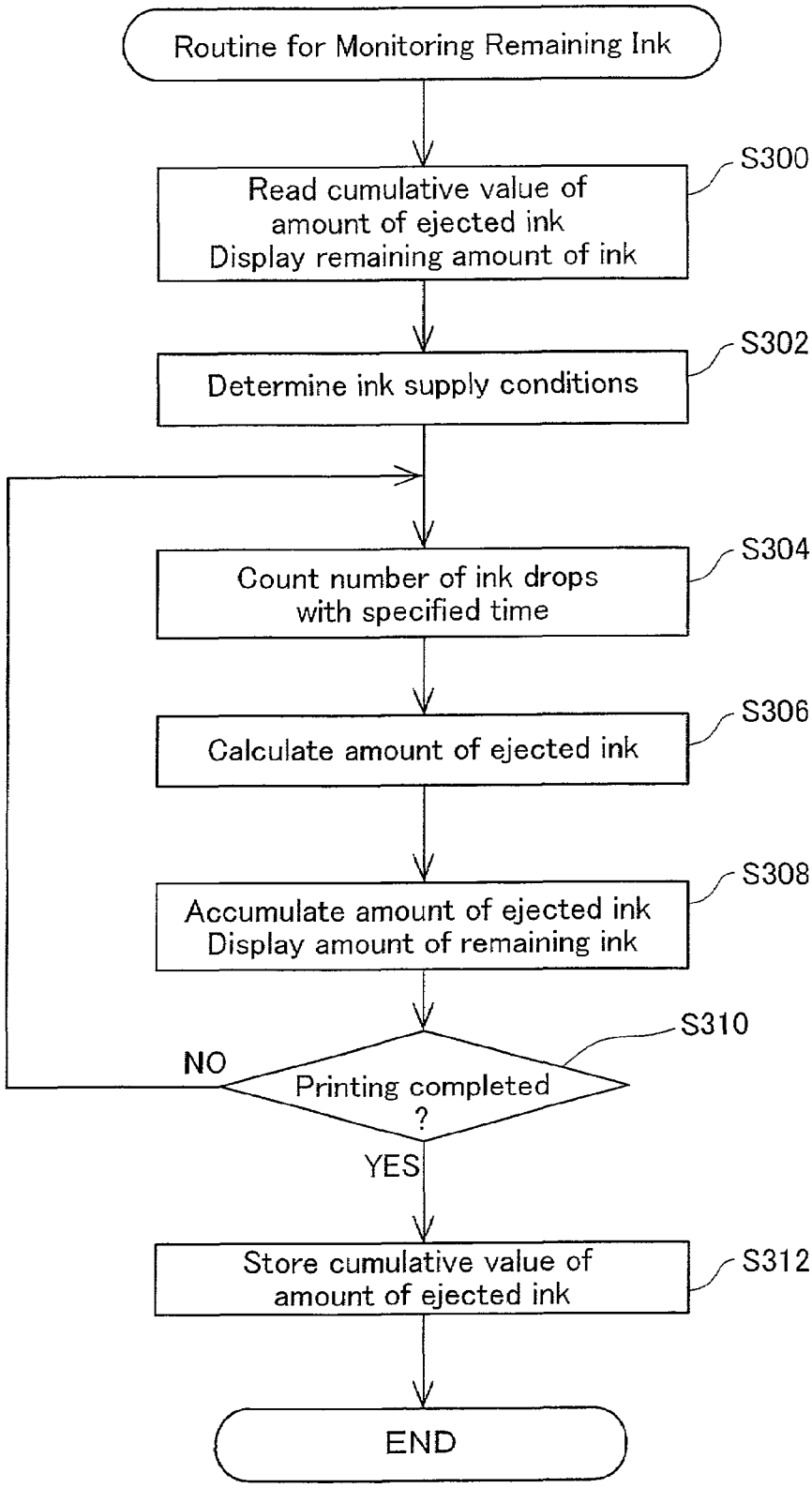
FIG. 19 is a flowchart depicting a procedure for measuring the amount of remaining ink.

FIG. 19 is a flowchart depicting a procedure for measuring the amount of remaining ink. The amount of remaining ink can be measured by the printer driver 96 of the computer 90. The manner in which the amount of remaining ink is measured will now be described with reference to the flowchart in FIG. 19. In this case, memory 180 is a non-volatile memory.

(a) Reading of Cumulative Amount of Ejected Ink (step S300)

A routine for monitoring the amount of remaining ink is immediately initiated once the printer 20 is turned on, and an ink remainder measurement unit 68 (FIG. 5) reads the cumulative amount of the ejected ink from the memory 180 through the agency of the memory interface unit 67 (step S300). The cumulative amount of ejected ink has been written to the memory at the end of the previous execution of the remaining ink monitoring routine, and the cumulative value is first read when the routine is initiated again. The color printer 20 stores the cumulative amount of ejected ink for each of $C_D$ (cyan), $C_L$ (light cyan), $M_D$ (magenta), $M_L$ (light magenta), $Y_D$ (yellow), and $K_D$ (black).

The remaining amount of ink in the cartridge is measured by comparing the ink capacity of the ink cartridge, or the initial ink amount, and the cumulative amount of ejected ink.

(b) Determining Ink Supply Conditions (step S302)

The ink remainder measurement unit 68 determines the ink supply conditions (step S302) after the cumulative amount of ejected ink has been read. The ink supply conditions include ink temperature, ink type, and the remaining amount of ink in the ink cartridge.

(c) Ink Drop Count Within Specific Period (step S304)

After determining the ink supply conditions, the ink remainder measurement unit 68 counts the number of ink drops which are ejected within a specific period for each ink color (step S304). For example, the ink remainder measurement unit 68 differentiates among ink dots of different sizes when the color printer 20 forms three types of ink dots: large, medium, and small. In other words, the unit 68 counts the number of ink drops separately for each of the large, medium, and small dots.

(d) Calculation of Amount of Ejected Ink (step S306)

After counting the numbers of ink dots within a specific period, the ink remainder measurement unit 68 multiplies the counts by the respective weights of ink drops for three drop sizes, and add the results to obtain the amount of ejected ink (step S306). The weight of ink drops varies under varying ink supply conditions (which are related to the supply of ink), so the accuracy of the calculated amount of ejected ink in step S306 is increased by taking into account the ink supply conditions determined in advance in step S302. The volume of ejected ink may also be calculated by adopting a procedure in which volume data are stored instead of the weight per ink drop, and the number of ejected ink drops is multiplied by the ink volume.

(e) Displaying Amount of Remaining Ink and Cumulative Value of Ejected Ink, and Other Operations (steps S308–S312)

Once the weight of the ink ejected during a specific period has been calculated, the ink remainder measurement unit 68 adds the resulting value to the previously calculated weight of ejected ink.

When the above procedure is completed, it is determined whether printing is completed (step S310), and if the answer is negative, the operation returns to step S304, and the next series of operations is an repeated. If the answer is positive, the cumulative value of the amount of ejected ink is stored in the memory 180 (step S312) for the next printing operation. Adopting this arrangement allows the amount of ejected ink to be accumulated and the amount of ink remaining in the ink cartridge to be monitored even when the printing apparatus is turned off.

D. Selection of Cleaning Method

Nozzles are sometimes clogged due to increased ink viscosity, bubbling, or other factors. In particular, pigment inks are more prone to clogging than dye inks, and tend to be less amenable to dissolve it. An appropriate cleaning method should therefore be established in accordance with the type of ink stored in the ink tank.

Figure 20:
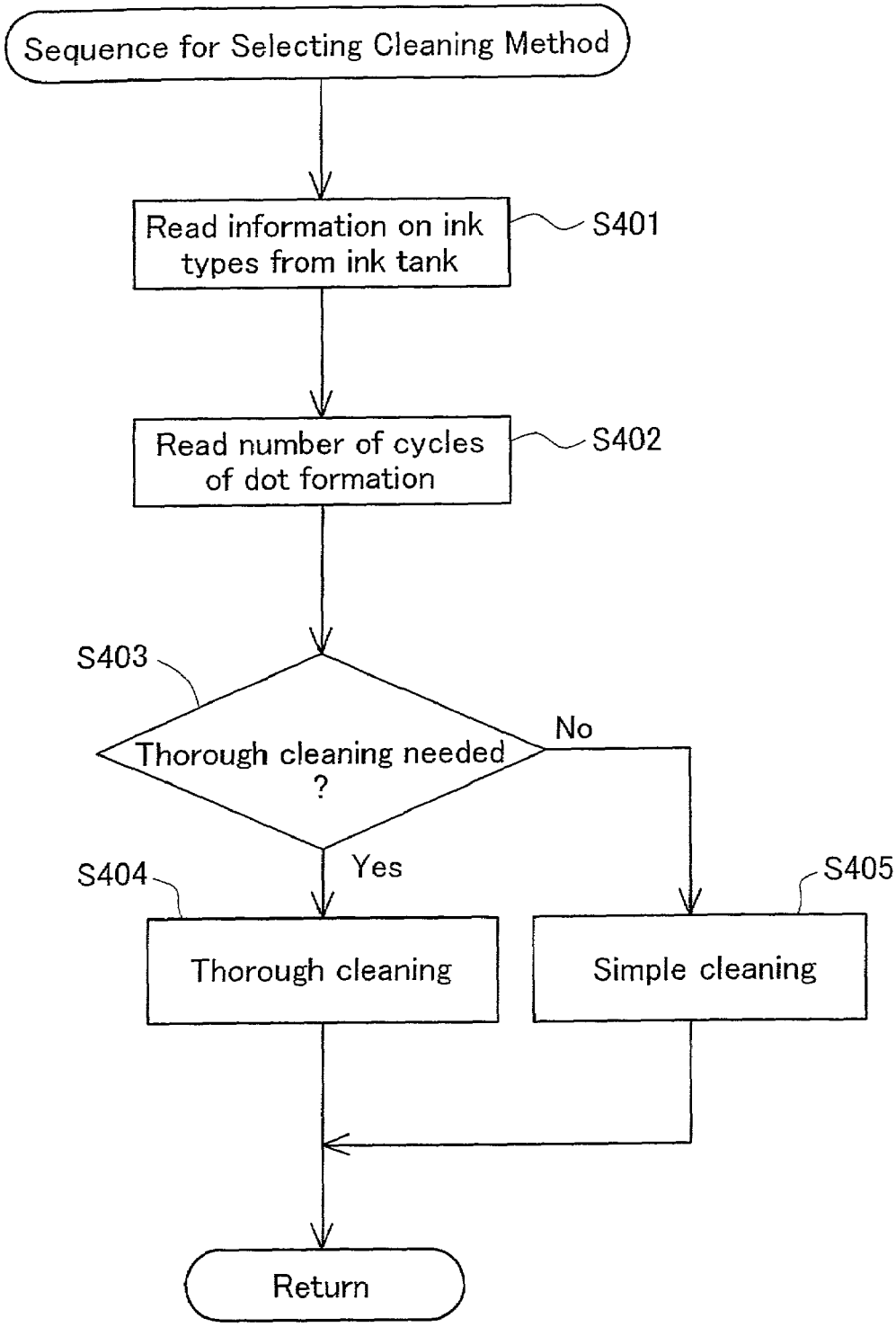
FIG. 20 is a flowchart depicting a sequence for selecting a cleaning method.

FIG. 20 is a flowchart depicting the sequence of selecting a cleaning method. In step S401, ink type data for each ink tank are read from the memory provided to the ink tank. In step S402, the pre-counted number of dots to be formed by each nozzle array may, for example, be read from the head drive circuit 52. An appropriate cleaning method is selected in step S403. Specifically, the cleaning method is selected by evaluating the actual need for cleaning on the basis of the type of ink used by the nozzle array and the number of dot-forming cycles. For example, particularly thorough cleaning is selected when a nozzle array for ejecting a pigment ink is to perform a large number of dot-forming cycles. This function is implemented by a program stored in the PROM 43 and executed by the CPU 41 (FIG. 3) in the control circuit 40.

E. Specifics of Data Stored in Memory Provided to Ink Tank or Ink Cartridge

FIG. 21 is a diagram depicting another example of data stored in the memory 180F provided to a color ink cartridge 107F. In this example, the memory 180F contains the following data.

(1) Ink Type Data ITD: Ink type data stored in the color ink cartridge 107F.

(2) First Drive Waveform Data DW1: Data on optimum drive waveforms for the types of ink stored in the color ink cartridge 107F. In the example shown in FIG. 21, all five color inks are dyes, so drive waveform data for dye inks are stored as first drive waveform data DW1.

(3) First Mask Data MD1: Mask data suitable for first drive waveform data DW1.

(4) Second Drive Waveform Data DW2: Data on the drive waveforms to be used when the ink stored in the color ink cartridge 107F is a combination with other types of ink. The second drive waveform data DW2 are common drive waveform data for dye/pigment combinations.

(5) Second Mask Data MD2: Mask data suitable for second drive waveform data DW2.

(6) Correction Data CD: Data for correcting drive waveforms on the basis of humidity, print head temperature, and actuator rank.

(7) Ink Remainder IR: Indicates the remaining amount of each ink in the color ink cartridge 107F.

Seven types of data should preferably be stored in the memory 180*k* of the black ink cartridge 107*k* in the same manner as above.

Adequate drive waveforms can be generated when various cartridges are combined in the printer 20 by adopting an approach in which mask data or third drive waveform data used together with other ink cartridges are stored in the memories of the ink cartridges in addition tot eh first and second drive waveform data DW1 and DW2 or the mask data MD1 and MD2, which are suitable for the types of inks stored in the ink cartridges, as shown in FIG. 21.

F. Modified Examples

The present invention is not limited to the above-described embodiments or embodiments and can be implemented in a variety of ways as long as the essence thereof is not compromised. The following modifications are possible, for example.

F-1.

Although the above embodiments are described with reference to a case in which each ink tank is provided with a single memory, a plurality of memories may also be provided. In such cases, the preferred option is to equip the ink tank with a rewritable memory (such as EEPROM) and write-once memory, to use the rewritable memory for storing information that varies as the ink cartridge is used up (such as the amount of remaining ink), and to use the write-once memory for storing information that remains unchanged as the ink cartridge is used up (such as ink type or cleaning sequence information).

As used herein, the term "cleaning sequence information" refers to information about the operations needed to clean the ink conduit extending from an ink cartridge to a nozzle, and the term "cleaning sequence" refers to the specifics (for example, ink suction procedures) of the cleaning operation performed when a nozzle is clogged or an ink cartridge mounted.

F-2.

Although the above embodiments are described with reference to cases in which the drive waveform data represent a plurality of drive waveform levels that varied as a chronological series, it is also possible, for example, to use data capable of reproducing drive waveforms by interpolation of some element data. The drive waveform data used in the present invention should commonly be capable of reproducing the waveforms of drive signals for driving a plurality of drive elements. The interpolation processing can be performed on the printer side, or it can be performed on the computer side after drive waveform data have been transmitted to the computer.

F-3.

The present invention can be used not only for color printing but also for monochromatic printing. It can also be adapted to a printing process in which a multilevel gradation is reproduced by representing a single pixel as a plurality of dots. The invention can also be adapted to a drum type printer. In a drum type printer, the direction of drum rotation is the direction of main scanning, and the direction of carriage travel is the direction of sub-scanning. In addition, the present invention can be adapted not only to an ink-jet printer but also to any other dot-recording devices in which images are recorded on the surface of a print medium with the aid of a recording head having a plurality of nozzle arrays.

F-4.

When some or all of the functions of the present invention are performed by software, this software (computer programs) can be provided in the form in which it is stored on a computer-readable recording medium. As used in connection with the present invention, the term "computer-readable recording medium" is not limited to a portable recording media such as a floppy disk or CD-ROM and includes internal computer storage devices (various types of memory) and external storage devices mounted in computers (e.g. hard disk).

Although the present invention has been described and illustrated in detail, it is clearly understood that the same is by way of illustration and example only and is not to be taken by way of limitation, the spirit and scope of the present invention being limited only by the terms of the append claims.

What is claimed is:

1. A printing apparatus for printing by forming ink dots on a print medium, the printing apparatus comprising:

an ink tank mount;

a print head having a plurality of nozzles for ejecting ink and a plurality of drive elements for actuating the plurality of nozzles;

a plurality of ink tanks detachably supported in the ink tank mount and each of the plurality of ink tanks having a memory, each of the plurality of memories storing ink type data representing an ink type contained in each of the plurality of ink tanks, at least one memory among the plurality of memories storing drive waveform data suitable for the type of ink contained in the ink tank having the at least one memory and drive waveform data suitable for all types of the ink contained in the plurality of ink tanks;

a memory read unit configured to read out the drive waveform data from the at least one memory; and a drive signal generator configured to generate a drive signal based on the drive waveform data, wherein the drive signal generator is configured to select one of the plurality of drive waveform data in response to the ink type data read out from each of the plurality of memories, and if all the read out ink type data represents a common ink type then to select the drive waveform data suitable for the common ink type, while if the read out ink type data represents a plurality of ink types then to select the drive waveform data suitable for each of the plurality of ink types.

2. The printing apparatus in accordance with claim 1, wherein the at least one memory stores drive waveform data selected in response to a type of ink contained in the ink tank from a plurality of types of drive waveform data suitable for a plurality of types of inks.

3. The printing apparatus in accordance with claim 2, wherein the plurality of nozzles are divided into a plurality of nozzle groups for ejecting mutually different types of inks;

the drive signal generator comprises a plurality of drive waveform generation circuits capable of generating mutually different drive signals; and the plurality of drive waveform generation circuits are configured to drive the plurality of nozzle groups, respectively.

4. The printing apparatus in accordance with claim 1, wherein the drive signal generator corrects the drive signals based on at least one of factors selected from humidity, temperature of the print head, and an ejection characteristic rank, the ejection characteristic rank indicating at least one ink ejection characteristic of the print head.

5. The printing apparatus in accordance with claim 1, wherein the at least one memory is a rewritable nonvolatile memory;

the memory read unit is configured to further read out an initial amount of each type of ink in each ink tank from the nonvolatile memory at least when the ink tank is mounted on the ink tank mount;

the printing apparatus further comprises:

a calculating unit configured to calculate a remaining amount of each type of ink in each ink tank based on an amount of ejected ink from each ink tank and the initial amount of each type of ink; and a memory write unit configured to write in the nonvolatile memory the remaining amount of each type of ink in each ink tank at an end of printing;

the drive signal generator is configured to correct the drive waveform data in response to the remaining amount of each type of ink.

6. The printing apparatus in accordance with claim 1, wherein the at least one memory is a write-once memory.

7. The printing apparatus in accordance with claim 6, wherein the write-once memory further stores cleaning sequence information that shows specifics of a cleaning procedure for cleaning the nozzles.

8. The printing apparatus in accordance with claim 6, wherein each of the plurality of ink tanks is further equipped with a rewritable nonvolatile memory;

the memory read unit is configured to further read out an initial amount of each type of ink in each ink tank from the nonvolatile memory at least when each of the plurality of ink tanks is mounted on the ink tank mount;

the printing apparatus further comprises:

a calculating unit configured to calculate a remaining amount of each type of ink in each ink tank based on an amount of ejected ink from each ink tank and the initial amount of each type of ink; and a memory write unit configured to write in the nonvolatile memory the remaining amount of each type of ink in each ink tank at an end of printing;

the drive signal generator is configured to correct the drive waveform data in response to the remaining amount of each type of ink.

9. The printing apparatus in accordance with claim 1, wherein the plurality of ink tanks contain at least one of a pigment ink and a dye ink, and the plurality of memories store drive waveform data suitable for the pigment ink, drive waveform data suitable for the dye ink, and drive waveform data suitable for both of the pigment ink and the dye ink.

10. A method of printing by forming ink dots on a print medium, the method comprising the steps of:

(a) providing a print head having a plurality of nozzles for ejecting ink and a plurality of drive elements for actuating the plurality of nozzles, and a plurality of ink tanks detachably supported in an ink tank mount, each of the plurality of ink tanks having a memory, each of the plurality of memories storing ink type data representing an ink type contained in each of the plurality of ink tanks, at least one memory among the plurality of memories storing drive waveform data suitable for the type of ink contained in the ink tank having the at least one memory and drive waveform data suitable for all types of the ink contained in the plurality of ink tanks;

(b) reading out the drive waveform data from the at least one memory; and (c) generating the drive signal based on the drive waveform data, wherein the generating includes selecting one of the plurality of drive waveform data in response to the ink type data read out from each of the plurality of memories, and if all the read out ink type data represents a common ink type then selecting the drive waveform data suitable for the common ink type, while if the read out ink type data represents a plurality of ink types then selecting the drive waveform data suitable for each of the plurality of ink types.

11. The method in accordance with claim 10, wherein the at least one memory stores drive waveform data selected in response to a type of ink contained in the ink tank from a plurality of types of drive waveform data suitable for a plurality of types of inks.

12. The method in accordance with claim 11, wherein the method further comprises a step of dividing the plurality of nozzles into a plurality of nozzle groups for ejecting mutually different types of inks; and the step (c) includes the steps of:

(d) generating a plurality of mutually different drive signals;

(e) driving the plurality of nozzle groups by using the plurality of mutually different drive signals, respectively.

13. The method in accordance with claim 10, wherein the step (c) includes a step of correcting the drive signals based on at least one of factors selected from humidity, temperature of the print head, and an ejection characteristic rank, the ejection characteristic rank indicating an ink ejection characteristics of the print head.

14. The method in accordance with claim 10, wherein the at least one memory is a rewritable nonvolatile memory;

the method further comprises the steps of:

(g) reading out an initial amount of each type of ink in each ink tank from the nonvolatile memory at least when the ink tank is mounted on an ink tank mount;

(h) calculating a remaining amount of each type of ink in each ink tank based on an amount of ejected ink from each ink tank and the initial amount of each type of ink;

(i) writing in the nonvolatile memory the remaining amount of each type of ink in each ink tank at an end of printing; and (j) correcting the drive waveform data in response to the remaining amount of each type of ink.

15. The method in accordance with claim 10, wherein the at least one memory is a write-once memory.

16. The method in accordance with claim 15, further comprising a step of:

(k) storing cleaning sequence information in the write-once memory, the cleaning sequence information showing specifics of a cleaning procedure for cleaning the nozzles.

17. The method in accordance with claim 15, wherein the ink tank is further equipped with a rewritable nonvolatile memory;

the method further comprises the steps of:

(g) reading out an initial amount of each type of ink in each ink tank from the nonvolatile memory at least when the ink tank is mounted on an ink tank mount;

(h) calculating a remaining amount of each type of ink in each ink tank based on an amount of ejected ink from each ink tank and the initial amount of each type of ink;

(i) writing in the nonvolatile memory the remaining amount of each type of ink in each ink tank at an end of printing; and (j) correcting the drive waveform data in response to the remaining amount of each type of ink.

18. A computer program product for causing a computer to generate drive signals to be supplied to a print head in order to print by forming ink dots on a print medium using a plurality of ink tanks detachably supported in an ink tank mount, each of the plurality of ink tanks having a memory, each of the plurality of memories storing ink type data representing an ink type contained in each of the plurality of ink tanks, at least one memory among the plurality of memories storing drive waveform data suitable for the type of ink contained in the ink tank having the at least one memory and drive waveform data suitable for all types of the ink contained in the plurality of ink tanks and the print head, the print head having a plurality of nozzles for ejecting ink and a plurality of drive elements for actuating the plurality of nozzles, the computer program product comprising:

a computer readable medium; and a computer program stored on the computer readable medium, the computer program comprising:

a first program for causing the computer to read out drive waveform data from the at least one memory, the drive waveform data defining a shape of a waveform of a drive signal which actuates the plurality of drive elements; and a second program for causing the computer to generate the drive signals based on the drive waveform data, the second program further selecting one of the plurality of drive waveform data in response to the ink type data read out from each of the plurality of memories, and if all the read out ink type data represents a common ink type then selecting the drive waveform data suitable for the common ink type, while if the read out ink type data represents a plurality of ink types then selecting the drive waveform data suitable for each of the plurality of ink types.

19. The computer program product in accordance with claim 18, wherein the at least one memory stores drive waveform data selected in response to a type of ink contained in the ink tank from a plurality of types of drive waveform data suitable for a plurality of types of inks.

20. The computer program product in accordance with claim 19, wherein the computer program further comprises:

a program for causing the computer to divide the plurality of nozzles into a plurality of nozzle groups for ejecting mutually different types of inks; and the second program further comprises:

a program for the computer to generate a plurality of mutually different drive signals;

a program for the computer to drive each of the plurality of nozzle groups by using the plurality of the mutually different drive signals, respectively.

21. The computer program product in accordance with claim 18, wherein the second program comprises a program for causing the computer to correct the drive signals based on at least one of factors selected from humidity, temperature of the print head, and an ejection characteristic rank, the ejection characteristic rank indicating an ink ejection characteristics of the print head.

22. The computer program product in accordance with claim 18, wherein the at least one memory is a rewritable nonvolatile memory;

the computer program further comprises:

a program for causing the computer to read out an initial amount of each type of ink in each ink tank from the nonvolatile memory at least when the ink tank is mounted on an ink tank mount;

a program for causing the computer to calculate a remaining amount of each type of ink in each ink tank based on an amount of ejected ink from each ink tank and the initial amount of each type of ink;

a program for causing the computer to write in the nonvolatile memory the remaining amount of each type of ink in each ink tank at an end of printing; and a program for causing the computer to correct the drive waveform data in response to the remaining amount of each type of ink.

23. The computer program product in accordance with claim 18, wherein the at least one memory is a write-once memory.

24. The computer program product in accordance with claim 23, wherein the write-once memory further stores cleaning sequence information that shows specifics of a cleaning procedure for cleaning the nozzles.

25. The computer program product in accordance with claim 23, wherein at least one of the plurality of ink tanks is further equipped with a rewritable nonvolatile memory;

the computer program further comprises:

a program for causing the computer to read out an initial amount of each type of ink in each ink tank from the nonvolatile memory at least when the at least one ink tank is mounted on the ink tank mount;

a program for causing the computer to calculate a remaining amount of each type of ink in each ink tank based on an amount of ejected ink from each ink tank and the initial amount of each type of ink;

a program for causing the computer to write in the nonvolatile memory the remaining amount of each type of ink in each ink tank at an end of printing; and a program for causing the computer to correct the drive waveform data in response to the remaining amount of each type of ink.

* * * * *